US007207395B2

(12) United States Patent
Zupanick

(10) Patent No.: US 7,207,395 B2
(45) Date of Patent: Apr. 24, 2007

(54) METHOD AND SYSTEM FOR TESTING A PARTIALLY FORMED HYDROCARBON WELL FOR EVALUATION AND WELL PLANNING REFINEMENT

(75) Inventor: Joseph A. Zupanick, Pineville, WV (US)

(73) Assignee: CDX Gas, LLC, Dallas, TX (US)

( * ) Notice: Subject to any disclaimer, the term of this patent is extended or adjusted under 35 U.S.C. 154(b) by 309 days.

(21) Appl. No.: 10/769,221

(22) Filed: Jan. 30, 2004

(65) Prior Publication Data

US 2005/0167156 A1 Aug. 4, 2005

(51) Int. Cl.
*E21B 7/00* (2006.01)
*E21B 47/00* (2006.01)

(52) U.S. Cl. ..... 175/40; 166/250.16; 175/57

(58) Field of Classification Search ..... 175/40, 175/50, 57; 166/250.16
See application file for complete search history.

(56) References Cited

U.S. PATENT DOCUMENTS

| | | | | |
|---|---|---|---|---|
| 54,144 | A | 4/1866 | Hamar | |
| 274,740 | A | 3/1883 | Douglass | |
| 526,708 | A | 10/1894 | Horton | |
| 639,036 | A | 12/1899 | Heald | |
| 1,189,560 | A | 7/1916 | Gondos | |
| 1,285,347 | A | 11/1918 | Otto | |
| 1,467,480 | A | 9/1923 | Hogue | |
| 1,485,615 | A | 3/1924 | Jones | |
| 1,488,106 | A | 3/1924 | Fitzpatrick | |
| 1,520,737 | A | 12/1924 | Wright | |
| 1,674,392 | A | 6/1928 | Flansburg | |
| 1,777,961 | A | 10/1930 | Capeliuschnicoff | |
| 2,018,285 | A | 10/1935 | Schweitzer et al. | 166/21 |
| 2,069,482 | A | 2/1937 | Seay | 255/76 |
| 2,150,228 | A | 3/1939 | Lamb | 166/10 |
| 2,169,718 | A | 8/1939 | Boll et al. | 255/24 |
| 2,335,085 | A | 11/1943 | Roberts | 251/197 |
| 2,450,223 | A | 9/1948 | Barbour | 255/76 |

(Continued)

FOREIGN PATENT DOCUMENTS

AU 85/49964 A 11/1986

(Continued)

OTHER PUBLICATIONS

Notes on Consol Presentation (by P. Thakur) made at IOGA PA in Pittsburgh, Pennsylvania on May 22, 2002 (3 pages).

(Continued)

*Primary Examiner*—Hoang Dang
(74) *Attorney, Agent, or Firm*—Fish & Richardson P.C.

(57) ABSTRACT

A method and system for testing a partially formed well includes forming a first well bore intersecting a subterranean formation. The first well bore includes a portion of a planned well having a first configuration. A production characteristic of the subterranean formation is tested through the first well bore in the first configuration. The first well bore is reconfigured to a second configuration different from the first configuration. The production characteristic of the subterranean formation is re-tested through the first well bore in the second configuration. Further formation of the planned well is planned based on testing of the subterranean formation through the first well bore in the first and second configurations.

18 Claims, 5 Drawing Sheets

U.S. PATENT DOCUMENTS

| | | | | |
|---|---|---|---|---|
| 2,490,350 | A | 12/1949 | Grable | 166/4 |
| 2,679,903 | A | 6/1954 | McGowen, Jr. et al. | 166/1 |
| 2,726,063 | A | 12/1955 | Ragland et al. | 255/1.8 |
| 2,726,847 | A | 12/1955 | McCune et al. | 255/1.6 |
| 2,783,018 | A | 2/1957 | Lytle | 251/25 |
| 2,797,893 | A | 7/1957 | McCune et al. | |
| 2,847,189 | A | 8/1958 | Shook | 255/76 |
| 2,911,008 | A | 11/1959 | Du Bois | 137/625.31 |
| 2,934,904 | A | 5/1960 | Hendrix | |
| 2,980,142 | A | 4/1961 | Turak | 137/637.3 |
| 3,163,211 | A | 12/1964 | Henley | |
| 3,208,537 | A | 9/1965 | Scarborough | 175/53 |
| 3,347,595 | A | 10/1967 | Dahms et al. | 299/4 |
| 3,385,382 | A | 5/1968 | Canalizo et al. | |
| 3,443,648 | A | 5/1969 | Howard | 175/103 |
| 3,473,571 | A | 10/1969 | Dugay | 137/625.4 |
| 3,503,377 | A | 3/1970 | Beatenbough et al. | 123/117 |
| 3,528,516 | A | 9/1970 | Brown | 175/267 |
| 3,530,675 | A | 9/1970 | Turzillo | 61/35 |
| 3,534,822 | A | 10/1970 | Campbell et al. | |
| 3,578,077 | A | 5/1971 | Glenn, Jr. et al. | |
| 3,582,138 | A | 6/1971 | Loofbourow et al. | |
| 3,587,743 | A | 6/1971 | Howard | |
| 3,684,041 | A | 8/1972 | Kammerer, Jr. et al. | 175/267 |
| 3,687,204 | A | 8/1972 | Marshall et al. | |
| 3,692,041 | A | 9/1972 | Bondi | 137/238 |
| 3,744,565 | A | 7/1973 | Brown | |
| 3,757,876 | A | 9/1973 | Pereau | 175/267 |
| 3,757,877 | A | 9/1973 | Leathers | 175/269 |
| 3,759,328 | A | 9/1973 | Ueber et al. | |
| 3,763,652 | A | 10/1973 | Rinta | |
| 3,800,830 | A | 4/1974 | Etter | 137/625.41 |
| 3,809,519 | A | 5/1974 | Garner | 425/245 |
| 3,825,081 | A | 7/1974 | McMahon | 175/73 |
| 3,828,867 | A | 8/1974 | Elwood | 175/45 |
| 3,874,413 | A | 4/1975 | Valdez | 137/625.47 |
| 3,887,008 | A | 6/1975 | Canfield | 166/267 |
| 3,902,322 | A | 9/1975 | Watanabe | 61/35 |
| 3,907,045 | A | 9/1975 | Dahl et al. | 175/45 |
| 3,934,649 | A | 1/1976 | Pasini, III et al. | 166/254 |
| 3,957,082 | A | 5/1976 | Fuson et al. | 137/625.41 |
| 3,961,824 | A | 6/1976 | Van Eek et al. | 299/17 |
| 4,011,890 | A | 3/1977 | Andersson | 137/625.4 |
| 4,020,901 | A | 5/1977 | Pisio et al. | |
| 4,022,279 | A | 5/1977 | Driver | 166/271 |
| 4,030,310 | A | 6/1977 | Schirtzinger | |
| 4,037,658 | A | 7/1977 | Anderson | 166/272 |
| 4,060,130 | A | 11/1977 | Hart | |
| 4,073,351 | A | 2/1978 | Baum | 175/14 |
| 4,089,374 | A | 5/1978 | Terry | 166/259 |
| 4,116,012 | A | 9/1978 | Abe et al. | 405/238 |
| 4,134,463 | A | 1/1979 | Allen | 175/53 |
| 4,136,996 | A | 1/1979 | Burns | |
| 4,151,880 | A | 5/1979 | Vann | |
| 4,156,437 | A | 5/1979 | Chivens et al. | 137/554 |
| 4,169,510 | A | 10/1979 | Meigs | 175/65 |
| 4,182,423 | A | 1/1980 | Ziebarth et al. | |
| 4,189,184 | A | 2/1980 | Green | 299/8 |
| 4,220,203 | A | 9/1980 | Steeman | 166/271 |
| 4,221,433 | A | 9/1980 | Jacoby | 299/4 |
| 4,222,611 | A | 9/1980 | Larson et al. | |
| 4,224,989 | A | 9/1980 | Blount | 166/250 |
| 4,226,475 | A | 10/1980 | Frosch et al. | |
| 4,257,650 | A | 3/1981 | Allen | 299/2 |
| 4,278,137 | A | 7/1981 | Van Eek | 175/267 |
| 4,283,088 | A | 8/1981 | Tabakov et al. | 299/2 |
| 4,296,785 | A | 10/1981 | Vitello et al. | 141/105 |
| 4,299,295 | A | 11/1981 | Gossard | 175/45 |
| 4,303,127 | A | 12/1981 | Freel et al. | 166/266 |
| 4,305,464 | A | 12/1981 | Masszi | 166/370 |
| 4,312,377 | A | 1/1982 | Knecht | 137/625.19 |
| 4,317,492 | A | 3/1982 | Summers et al. | 175/79 |
| 4,328,577 | A | 5/1982 | Abbott et al. | 370/84 |
| 4,333,539 | A | 6/1982 | Lyons et al. | 175/61 |
| 4,356,866 | A | 11/1982 | Savins | |
| 4,366,988 | A | 1/1983 | Bodine | 299/14 |
| 4,372,398 | A | 2/1983 | Kuckes | 175/45 |
| 4,386,665 | A | 6/1983 | Dellinger | 175/61 |
| 4,390,067 | A | 6/1983 | Willman | 166/245 |
| 4,396,075 | A | 8/1983 | Wood et al. | |
| 4,396,076 | A | 8/1983 | Inoue | 175/265 |
| 4,397,360 | A | 8/1983 | Schmidt | 175/61 |
| 4,401,171 | A | 8/1983 | Fuchs | 175/267 |
| 4,407,376 | A | 10/1983 | Inoue | 175/267 |
| 4,415,205 | A | 11/1983 | Rehm et al. | |
| 4,417,829 | A | 11/1983 | Berezoutzky | |
| 4,422,505 | A | 12/1983 | Collins | |
| 4,437,706 | A | 3/1984 | Johnson | 299/7 |
| 4,442,896 | A | 4/1984 | Reale et al. | 166/278 |
| 4,463,988 | A | 8/1984 | Bouck et al. | |
| 4,494,616 | A | 1/1985 | McKee | 175/67 |
| 4,502,733 | A | 3/1985 | Grubb | |
| 4,512,422 | A | 4/1985 | Knisley | 175/99 |
| 4,519,463 | A | 5/1985 | Schuh | 175/61 |
| 4,527,639 | A | 7/1985 | Dickinson, III et al. | 175/61 |
| 4,532,986 | A | 8/1985 | Mims et al. | 166/50 |
| 4,533,182 | A | 8/1985 | Richards | |
| 4,536,035 | A | 8/1985 | Huffman et al. | |
| 4,544,037 | A | 10/1985 | Terry | 166/369 |
| 4,558,744 | A | 12/1985 | Gibb | 166/335 |
| 4,565,252 | A | 1/1986 | Campbell et al. | 175/269 |
| 4,573,541 | A | 3/1986 | Josse et al. | 175/78 |
| 4,599,172 | A | 7/1986 | Gardes | 210/314 |
| 4,600,061 | A | 7/1986 | Richards | 175/62 |
| 4,603,592 | A | 8/1986 | Siebold et al. | |
| 4,605,076 | A | 8/1986 | Goodhart | 175/61 |
| 4,611,855 | A | 9/1986 | Richards | 299/2 |
| 4,618,009 | A | 10/1986 | Carter et al. | 175/267 |
| 4,638,949 | A | 1/1987 | Mancel | 239/307 |
| 4,646,836 | A | 3/1987 | Goodhart | 166/303 |
| 4,651,836 | A | 3/1987 | Richards | |
| 4,662,440 | A | 5/1987 | Harmon et al. | |
| 4,674,579 | A | 6/1987 | Geller et al. | 175/45 |
| 4,676,313 | A | 6/1987 | Rinaldi | |
| 4,702,314 | A | 10/1987 | Huang et al. | 166/245 |
| 4,705,109 | A | 11/1987 | Ledent et al. | |
| 4,705,431 | A | 11/1987 | Gadelle et al. | 405/267 |
| 4,715,440 | A | 12/1987 | Boxell et al. | 166/100 |
| 4,718,485 | A | 1/1988 | Brown et al. | |
| RE32,623 | E | 3/1988 | Marshall et al. | |
| 4,727,937 | A | 3/1988 | Shum et al. | |
| 4,753,485 | A | 6/1988 | Goodhart | |
| 4,754,808 | A | 7/1988 | Harmon et al. | |
| 4,754,819 | A | 7/1988 | Dellinger | 175/61 |
| 4,756,367 | A | 7/1988 | Puri et al. | 166/263 |
| 4,763,734 | A | 8/1988 | Dickinson et al. | 175/61 |
| 4,773,488 | A | 9/1988 | Bell et al. | 175/61 |
| 4,776,638 | A | 10/1988 | Hahn | |
| 4,830,105 | A | 5/1989 | Petermann | 166/241 |
| 4,832,122 | A | 5/1989 | Corey et al. | |
| 4,836,611 | A | 6/1989 | El-Saie | 299/7 |
| 4,842,081 | A | 6/1989 | Parant | 175/23 |
| 4,844,182 | A | 7/1989 | Tolle | 175/215 |
| 4,852,666 | A | 8/1989 | Brunet et al. | 175/61 |
| 4,883,122 | A | 11/1989 | Puri et al. | 166/248 |
| 4,889,186 | A | 12/1989 | Hanson et al. | |
| 4,978,172 | A | 12/1990 | Schwoebel et al. | 299/12 |
| 5,016,709 | A | 5/1991 | Combe et al. | |
| 5,016,710 | A | 5/1991 | Renard et al. | 166/245 |
| 5,033,550 | A | 7/1991 | Johnson et al. | |
| 5,035,605 | A | 7/1991 | Dinerman et al. | 481/18 |
| 5,036,921 | A | 8/1991 | Pittard et al. | 166/298 |
| 5,074,360 | A | 12/1991 | Guinn | 166/281 |
| 5,074,365 | A | 12/1991 | Kuckes | 175/40 |

5,074,366 A 12/1991 Karlsson et al. ..... 175/76
5,082,054 A 1/1992 Kiamanesh ..... 166/248
5,111,893 A 5/1992 Kvello-Aune ..... 175/258
5,115,872 A 5/1992 Brunet et al.
5,127,457 A 7/1992 Stewart et al.
5,135,058 A 8/1992 Millgard et al. ..... 175/71
5,148,875 A 9/1992 Karlsson et al. ..... 175/62
5,148,877 A 9/1992 MacGregor
5,165,491 A 11/1992 Wilson ..... 175/62
5,168,942 A 12/1992 Wydrinski ..... 175/50
5,174,374 A 12/1992 Hailey ..... 166/55.8
5,193,620 A 3/1993 Braddick ..... 166/382
5,194,859 A 3/1993 Warren ..... 340/853.4
5,197,553 A 3/1993 Leturno ..... 175/57
5,197,783 A 3/1993 Theimer et al. ..... 299/17
5,199,496 A 4/1993 Redus et al. ..... 166/366
5,201,817 A 4/1993 Hailey ..... 175/269
5,207,271 A 5/1993 Sanchez et al.
5,217,076 A 6/1993 Masek ..... 166/303
5,226,495 A 7/1993 Jennings, Jr.
5,240,350 A 8/1993 Yamaguchi et al. ..... 405/143
5,242,017 A 9/1993 Hailey ..... 166/55.8
5,242,025 A 9/1993 Neill et al. ..... 175/26
5,246,273 A 9/1993 Rosar ..... 299/4
5,255,741 A 10/1993 Alexander ..... 166/278
5,271,472 A 12/1993 Leturno ..... 175/107
5,287,926 A 2/1994 Grupping
5,289,888 A 3/1994 Talley
5,301,760 A 4/1994 Graham ..... 175/61
5,343,965 A 9/1994 Talley et al.
5,355,967 A 10/1994 Mueller et al.
5,363,927 A 11/1994 Frank ..... 175/67
5,385,205 A 1/1995 Hailey ..... 166/55.8
5,394,950 A 3/1995 Gardes ..... 175/45
5,402,851 A 4/1995 Baiton ..... 166/369
5,411,082 A 5/1995 Kennedy ..... 166/181
5,411,085 A 5/1995 Moore et al. ..... 166/242
5,411,088 A 5/1995 LeBlanc et al. ..... 166/265
5,411,104 A 5/1995 Stanley ..... 175/65
5,411,105 A 5/1995 Gray ..... 175/69
5,431,220 A 7/1995 Lennon et al. ..... 166/55.7
5,431,482 A 7/1995 Russo
5,435,400 A 7/1995 Smith ..... 175/61
5,447,416 A 9/1995 Wittrisch ..... 417/442
5,450,902 A 9/1995 Matthews ..... 166/268
5,454,419 A 10/1995 Vloedman ..... 166/277
5,458,209 A 10/1995 Hayes et al. ..... 175/61
5,462,116 A 10/1995 Carroll ..... 166/249
5,462,120 A 10/1995 Gondouin ..... 166/380
5,469,155 A 11/1995 Archambeault et al. . 340/853.4
5,477,923 A 12/1995 Jordan, Jr. et al. ..... 66/313
5,485,089 A 1/1996 Kuckes ..... 324/346
5,494,121 A 2/1996 Nackerud ..... 175/263
5,499,687 A 3/1996 Lee ..... 175/317
5,501,273 A 3/1996 Puri ..... 166/252.5
5,501,279 A 3/1996 Garg et al. ..... 166/372
5,520,252 A 5/1996 McNair
5,584,605 A 12/1996 Beard et al. ..... 405/128
5,613,242 A 3/1997 Oddo ..... 588/17
5,615,739 A 4/1997 Dallas ..... 166/306
5,653,286 A 8/1997 McCoy et al. ..... 166/105.5
5,664,911 A 9/1997 Bridges et al.
5,669,444 A 9/1997 Riese et al. ..... 166/263
5,676,207 A 10/1997 Simon et al.
5,680,901 A 10/1997 Gardes ..... 166/313
5,690,390 A 11/1997 Bithell ..... 299/4
5,697,445 A 12/1997 Graham
5,706,871 A 1/1998 Anderson et al. ..... 141/59
5,720,356 A 2/1998 Gardes ..... 175/62
5,727,629 A 3/1998 Blizzard, Jr. et al. ..... 166/298
5,733,067 A 3/1998 Hunt et al.
5,735,350 A 4/1998 Longbottom et al. ..... 166/313
5,771,976 A 6/1998 Talley ..... 166/370
5,775,433 A 7/1998 Hammett et al. ..... 166/98
5,775,443 A 7/1998 Lott
5,785,133 A 7/1998 Murray et al. ..... 175/61
5,832,958 A 11/1998 Cheng ..... 137/625.41
5,853,054 A 12/1998 McGarian et al. ..... 175/267
5,853,056 A 12/1998 Landers ..... 175/424
5,853,224 A 12/1998 Riese ..... 299/13
5,863,283 A 1/1999 Gardes ..... 588/250
5,868,202 A 2/1999 Hsu ..... 166/256
5,868,210 A 2/1999 Johnson et al. ..... 175/40
5,879,057 A 3/1999 Schwoebel et al. ..... 299/17
5,884,704 A 3/1999 Longbottom et al. ..... 16/313
5,917,325 A 6/1999 Smith ..... 324/326
5,934,390 A 8/1999 Uthe ..... 175/67
5,938,004 A 8/1999 Roberts et al. ..... 198/812
5,941,307 A 8/1999 Tubel
5,941,308 A 8/1999 Malone et al. ..... 166/313
5,944,107 A 8/1999 Ohmer
5,957,539 A 9/1999 Durup et al. ..... 299/4
5,971,074 A 10/1999 Longbottom et al. ..... 166/313
5,988,278 A 11/1999 Johnson
5,992,524 A 11/1999 Graham
6,012,520 A 1/2000 Yu et al. ..... 166/245
6,015,012 A 1/2000 Reddick ..... 166/313
6,019,173 A 2/2000 Saurer et al.
6,024,171 A 2/2000 Montgomery et al. ..... 166/308
6,030,048 A 2/2000 Hsu
6,050,335 A 4/2000 Parsons ..... 166/272.3
6,056,059 A 5/2000 Ohmer ..... 166/313
6,062,306 A 5/2000 Gano et al.
6,065,550 A 5/2000 Gardes ..... 175/62
6,065,551 A 5/2000 Gourley et al.
6,079,495 A 6/2000 Ohmer
6,089,322 A 7/2000 Kelley et al.
6,119,771 A 9/2000 Gano et al. ..... 166/50
6,119,776 A 9/2000 Graham et al.
6,135,208 A 10/2000 Gano et al. ..... 166/313
6,170,571 B1 1/2001 Ohmer
6,179,054 B1 1/2001 Stewart ..... 166/105.5
6,189,616 B1 2/2001 Gano et al.
6,192,988 B1 2/2001 Tubel
6,199,633 B1 3/2001 Longbottom
6,209,636 B1 4/2001 Roberts et al. ..... 166/117.6
6,237,284 B1 5/2001 Erickson
6,244,340 B1 6/2001 McGlothen et al.
6,247,532 B1 6/2001 Ohmer
6,263,965 B1 7/2001 Schmidt et al.
6,279,658 B1 8/2001 Donovan et al.
6,280,000 B1 8/2001 Zupanick ..... 299/12
6,283,216 B1 9/2001 Ohmer
6,318,457 B1 11/2001 Den Boer et al.
6,349,769 B1 2/2002 Ohmer ..... 166/313
6,357,523 B1 3/2002 Zupanick ..... 166/52
6,357,530 B1 3/2002 Kennedy et al. ..... 166/369
6,425,448 B1 7/2002 Zupanick et al. ..... 175/61
6,439,320 B2 8/2002 Zupanick ..... 166/313
6,450,256 B2 9/2002 Mones ..... 166/250.01
6,454,000 B1 9/2002 Zupanick ..... 166/243
6,457,540 B2 10/2002 Gardes ..... 175/62
6,470,978 B2 10/2002 Trueman et al.
6,478,085 B2 11/2002 Zupanick ..... 166/50
6,491,101 B2 12/2002 Ohmer
6,497,556 B2 12/2002 Zupanick ..... 417/85
6,554,063 B2 4/2003 Ohmer
6,557,628 B2 5/2003 Ohmer
6,561,288 B2 5/2003 Zupanick ..... 175/69
6,564,867 B2 5/2003 Ohmer
6,566,649 B1 5/2003 Mickael ..... 250/269.3
6,571,888 B2 6/2003 Comeau ..... 175/61
6,575,235 B2 6/2003 Zupanick ..... 166/50
6,575,255 B1 6/2003 Rial et al.
6,577,129 B1 6/2003 Thompson ..... 324/338
6,581,455 B1 * 6/2003 Berger et al. ..... 73/152.55

| | | | | |
|---|---|---|---|---|
| 6,581,685 | B2 * | 6/2003 | Burgess et al. | 166/250.02 |
| 6,585,061 | B2 | 7/2003 | Radzinski | 175/45 |
| 6,590,202 | B2 | 7/2003 | Mickael | 250/269.4 |
| 6,591,903 | B2 | 7/2003 | Ingle | 166/50 |
| 6,591,922 | B1 | 7/2003 | Rial et al. | |
| 6,595,301 | B1 | 7/2003 | Diamond et al. | |
| 6,595,302 | B1 | 7/2003 | Diamond et al. | |
| 6,598,686 | B1 | 7/2003 | Zupanick | 175/62 |
| 6,604,580 | B2 | 8/2003 | Zupanick | 166/245 |
| 6,604,910 | B1 | 8/2003 | Zupanick | 417/36 |
| 6,607,042 | B2 | 8/2003 | Hoyer et al. | 175/38 |
| 6,636,159 | B1 | 10/2003 | Winnacker | 340/854.3 |
| 6,639,210 | B2 | 10/2003 | Odom et al. | 250/269.6 |
| 6,644,422 | B1 | 11/2003 | Rial et al. | |
| 6,646,441 | B2 | 11/2003 | Thompson et al. | |
| 6,653,839 | B2 | 11/2003 | Yuratich et al. | 324/355 |
| 6,662,870 | B1 | 12/2003 | Zupanick | 166/245 |
| 6,668,918 | B2 | 12/2003 | Zupanick | 166/50 |
| 6,679,322 | B1 | 1/2004 | Zupanick | 166/50 |
| 6,681,855 | B2 | 1/2004 | Zupanick | 166/50 |
| 6,688,388 | B2 | 2/2004 | Zupanick | 166/50 |
| 6,722,452 | B1 | 4/2004 | Rial et al. | |
| 6,758,279 | B2 | 7/2004 | Moore et al. | |
| RE38,642 | E | 11/2004 | Gondouin | |
| 2002/0043404 | A1 | 4/2002 | Trueman et al. | |
| 2002/0050358 | A1 | 5/2002 | Algeroy | 166/313 |
| 2002/0074120 | A1 | 6/2002 | Scott | 166/313 |
| 2002/0074122 | A1 | 6/2002 | Kelly et al. | 166/313 |
| 2002/0096336 | A1 | 7/2002 | Zupanick | 175/161 |
| 2002/0108746 | A1 | 8/2002 | Zupanick | 166/50 |
| 2002/0117297 | A1 | 8/2002 | Zupanick | 166/50 |
| 2002/0189801 | A1 | 12/2002 | Zupanick | 166/50 |
| 2003/0062198 | A1 | 4/2003 | Gardes | 175/61 |
| 2003/0066686 | A1 | 4/2003 | Conn | 175/57 |
| 2003/0075334 | A1 | 4/2003 | Haugen et al. | 166/313 |
| 2003/0106686 | A1 | 6/2003 | Ingle et al. | 166/245 |
| 2003/0164253 | A1 | 9/2003 | Trueman et al. | |
| 2003/0221836 | A1 | 12/2003 | Gardes | |
| 2003/0234120 | A1 * | 12/2003 | Paluch et al. | 175/50 |
| 2004/0007389 | A1 | 1/2004 | Zupanick | 175/61 |
| 2004/0007390 | A1 | 1/2004 | Zupanick | 175/61 |
| 2004/0011560 | A1 | 1/2004 | Rial et al. | |
| 2004/0020655 | A1 | 2/2004 | Rusby et al. | |
| 2004/0033557 | A1 | 2/2004 | Scott et al. | |
| 2004/0060351 | A1 | 4/2004 | Gunter et al. | |
| 2004/0140129 | A1 | 7/2004 | Gardes | |
| 2004/0226719 | A1 | 11/2004 | Morgan et al. | |
| 2005/0133219 | A1 | 6/2005 | Zupanick | |
| 2005/0252689 | A1 | 11/2005 | Gardes | |
| 2005/0257962 | A1 | 11/2005 | Zupanick | |
| 2006/0096755 | A1 | 5/2006 | Zupanick | |

FOREIGN PATENT DOCUMENTS

| | | | |
|---|---|---|---|
| CA | 2 278 735 | | 1/1998 |
| CA | 2210866 | | 1/1998 |
| DE | CH 653 741 | | 1/1986 |
| DE | 197 25 996 | A1 | 1/1998 |
| EP | 0 819 834 | A1 | 1/1998 |
| EP | 0 875 661 | A1 | 11/1998 |
| EP | 0 952 300 | A1 | 10/1999 |
| EP | 1 316 673 | A2 | 6/2003 |
| FR | 964503 | | 8/1950 |
| GB | 442008 | | 1/1936 |
| GB | 444484 | | 3/1936 |
| GB | 651468 | | 4/1951 |
| GB | 893869 | | 4/1962 |
| GB | 2 255 033 | | 10/1992 |
| GB | 2297 988 | | 8/1996 |
| GB | 2347157 | | 8/2002 |
| SU | 750108 | | 6/1975 |
| SU | 876968 | | 10/1981 |
| SU | 1448078 | A1 | 3/1987 |
| SU | 1770570 | A1 | 3/1990 |
| UA | 37720 | A | 5/2001 |
| WO | 94/21889 | | 9/1994 |
| WO | WO 94/21889 | | 9/1994 |
| WO | WO 97/21900 | | 6/1997 |
| WO | WO 98/25005 | | 6/1998 |
| WO | WO 98/35133 | | 8/1998 |
| WO | WO 99/60248 | | 11/1999 |
| WO | 00/31376 | | 6/2000 |
| WO | WO 00/79099 | | 12/2000 |
| WO | WO 01/44620 | | 6/2001 |
| WO | WO 02/18738 | | 3/2002 |
| WO | WO 02/059455 | | 8/2002 |
| WO | WO 02/061238 | A1 | 8/2002 |
| WO | WO 03/036023 | | 5/2003 |
| WO | WO 03/061238 | | 7/2003 |
| WO | WO 03/102348 | | 12/2003 |
| WO | WO 2004/035984 | A1 | 4/2004 |
| WO | WO 2005003509 | | 1/2005 |

OTHER PUBLICATIONS

Dreiling, Tim, McClelland, M.L. and Bilyeu, Brad, "Horizontal & High Angle Air Drilling in the San Juan Basin, New Mexico," Believed to be dated Apr. 1996, pp. 1-11.

Technology Scene Drilling & Intervention Services, "Weatherford Moves Into Advanced Multilateral Well Completion Technology" and "Productivity Gains and Safety Record Speed Acceptance of UBS," *Reservoir Mechanics*, Weatherford International, Inc., 2000 Annual Report (2 pages).

Santos, Helio, SPE, Inpact Engineering Solutions and Jesus Olaya, Ecopetrol/ICP, "*No-Damage Drilling: How to Achieve this Challenging Goal*?," SPE 77189, Copyright 2002, presented at the IADC/SPE Asia Pacific Drilling Technology, Jakarta, Indonesia, Sep. 09-11, 2002, 10 pages.

Santos, Helio, SPE, Impact Engineering Solutions, "*Increasing Leakoff Pressure with New Class of Drilling Fluid*," SPE 78243, Copyright 2002, presented at the SPE/ISRM Rock Mechanics Conference in Irving, Texas, Oct. 20-23, 2002, 7 pages.

Franck Labenski, Paul Reid, SPE, and Helio Santos, SPE, Impact Solutions Group, "*Drilling Fluids Approaches for Control of Wellbore Instability in Fractured Formations*," SPE/IADC 85304, Society of Petroleum Engineers, Copyright 2003, presented at the SPE/IADC Middle East Drilling Technology Conference & Exhibition in Abu Chabi, UAE, Oct. 20-22, 2003, 8 pages.

P. Reid, SPE, and H. Santos, SPE, Impact Solutions Group, "*Novel Drilling, Completion and Workover Fluids for Depleted Zones: Avoiding Losses, Formation Damage and Stuck Pipe*," SPE/IADC 85326, Society of Petroleum Engineers, Copyright 2003, presented at the SPE/IADC Middle East Drilling Conference & Exhibition in Abu Chabi, UAE, Oct. 20-22, 2003, 9 pages.

Craig C. White and Adrian P. Chesters, NAM; Catalin D. Ivan, Sven Maikranz and Rob Nouris, M-I L.L.C., "*Aphron-based drilling fluid: Novel technology for drilling depleted formations*," World Oil, Drilling Report Special Focus, Oct. 2003, 5 pages.

Robert E. Snyder, "Drilling Advances," World Oil, Oct. 2003, 1 page.

U.S. Environmental Protection Agency, "Directional Drilling Technology," prepared for the EPA by Advanced Resources International under Contract 68-W-00-094, Coalbed Methane Outreach Program (CMOP), published Dec. 2002, Website: http://search.epa.gov/s97is.vts, printed Mar. 17, 2005, 13 pages.

"Meridian Tests New Technology," Western Oil World, Jun. 1990, Cover, Table of Contents and p. 13.

Clint Leazer and Michael R. Marquez, "Short-Radius Drilling Expands Horizontal Well Applications," Petroleum Engineer International, Apr. 1995, 6 pages.

Terry r. Logan, "Horizontal Drainhole Drilling Techniques Used in Rocky Mountains Coal Seams," Geology and Coal-Bed Methane Resources of the Northern San Juan Basin, Colorado and New Mexico, Rocky Mountain Association of Geologists, Coal-Bed Methane, San Juan Basin, 1988, pp. cover, 133-142.

Daniel J. Brunner; Jeffrey J. Schwoebel, and Scott Thomson, "Directional Drilling for Methane Drainage & Exploration in Advance of Mining," Website: http://www.advminingtech.com.au/Paper4.htm, printed Apr. 6, 2005, Copyright 1999, Last modified Aug. 7, 2002 (8 pages).

Karen Bybee, highlights of paper SPE 84424, "Coalbed-Methane Reservoir Simulation: An Evolving Science," by T.L. Hower, JPT Online, Apr. 2004, Website: http://www.spe.org/spe/jpt/jsp/jptpapersynopsis/0,2439,1104_11038_2354946_2395832,00.html, printed Apr. 14, 2005, 4 pages.

Kevin meaney and Lincoln Paterson, "Relative Permeability in Coal, " SPE 36986, Society of Petroleum Engineers, Copyright 1996, pp. 231-236.

Calendar of Events—Conference Agenda, Fifth Annual Unconventional Gas and Coalbed Methane Conference, Oct. 22, 24, 2003, in Calgary Alberta, Website: http://www.csug.ca/cal/calc0301a.html, printed Mar. 17, 2005, 5 pages.

Tom Engler and Kent Perry, "Creating a Roadmap for Unconventional Gas R&D," Gas TIPS, Fall 2002, pp. 16-20.

CSIRO Petroleum—SIMEDWin, "Summary of SIMEDWin Capabilities," Copyright 1997-2005, Website: http://www.dpr.csiro.au/ourcapabilities/petroleumgeoengineering/reservoirengineering/projects/simedwin/assets/simed/index.html, printed Mar. 17, 2005, 10 pages.

Solutions From the Field, "Coalbed Methane Resources in the Southeast," Copyright 2004, Website: http://www.pttc.org/solutions/sol_2004/537.htm, printed Mar. 17, 2005, 7 pages.

Jeffrey R. Levine, Ph.D., "matrix Shrinkage Coefficient," Undated, 3 pages.

G. Twombly, S.H. Stepanek, T.A. Moore, Coalbed Methane Potential in the Waikato Coalfield of New Zealand: A Comparison With Developed Basins in the United States, 2004 New Zealand petroleum Conference Proceedings, Mar. 7-10, 2004, pp. 1-6.

R. W. Cade, "Horizontal Wells: Development and Applications," Presented at the Fifth International Symposium on Geophysics for Mineral, Geotechnical and Environmental Applications, Oct. 24-28, 1993 in Tulsa, Oklahoma, Website: http://www.mgls.org/93Sym/Cade/cade.html, printed Mar. 17, 2005, 6 pages.

Solutions From the Field, "Horizontal Drilling, A Technology Update for the Appalachian Basin," Copyright 2004, Website: http://www.pttc.org/solutions/sol_2004/535.htm, printed Mar. 17, 2005, 6 pages.

R. Purl, J.C. Evanoff and M.L. Brugler, "Measurement of Coal Cleat Porosity and Relative Permeability Characteristics," SPE 21491, Society of Petroleum Engineers, Copyright 1991, pp. 93-104.

Peter jackson, "Drilling Technologies for Underground Coal Gasification, " IMC Geophysics Ltd., International UCG Workshop—Oct. 2003 (20 pages).

Notification of Transmittal of the International Search Report and the Written Opinion of the International Searching Authority, or the Declaration (3 pages), International Search Report (3 pages) and Written Opinion of the International Searching Authority (5 pages) re International Application No. PCT/US2005/002162 mailed Apr. 22, 2005.

Notification of Transmittal of the International Search Report and the Written Opinion of the International Searching Authority, or the Declaration (3 pages), International Search Report (3 pages) and Written Opinion of the International Searching Authority (5 pages) re International Application No. PCT/US2005/005289 mailed Apr. 29, 2005.

Notification of Transmittal of the International Search Report and the Written Opinion of the International Searching Authority, or the Declaration (3 pages), International Search Report (5 pages) and Written Opinion of the International Searching Authority (5 pages) re International Application No. PCT/US2004/036616 mailed Feb. 24, 2005.

Notification of Transmittal of International Preliminary Examination Report (1 page) and International Preliminary Examination Report (3 pages) for International Application No. PCT/US03/13954 mailed Apr. 14, 2005.

Notification of Transmittal of International Preliminary Examination Report (1 page) and International Preliminary Examination Report (5 pages) mailed Jan. 18, 2005 and Written Opinion (8 pages) mailed Aug. 25, 2005 for International Application No. PCT/US03/30126.

Notification of Transmittal of the International Search Report or the Declaration (3 pages) and International Search Report (5 pages) mailed Nov. 10, 2000 for International Application No. PCT/US99/27494.

Notification of Transmittal of International Preliminary Examination Report (1 page) and International Preliminary Examination Report (6 pages) mailed Apr. 2, 2001 and Written Opinion mailed Sep. 27, 2000 for International Application No. PCT/US99/27494.

Notification of Transmittal of the International Search Report or the Declaration (3 pages) and International Search Report (5 pages) mailed Jun. 6, 2002 for International Application No. PCT/US02/02051.

Notification of Transmittal of the International Search Report or the Declaration (3 pages) and International Search Report (6 pages) mailed Mar. 13, 2003 for International Application No. PC/US02/33128.

Notification of Transmittal of International Preliminary Examination Report (1 page) and International Preliminary Examination Report (3 pages mailed Apr. 22, 2004 and Written Opinion mailed Sep. 4, 2003 for International Application No. PCT/US02/33128.

Listing of 174 References received from Third Pary on Feb. 16, 2005 (9 pages).

Gardes Directional Drilling, "Multiple Directional Wells From Single Borehole Developed," Reprinted from Jul. 1989 edition of Offshore, Copyright 1989 by PennWell Publishing Company (4 pages).

"Economic Justification and Modeling of Multilateral Wells," Economic Analysis, Hart's Petroleum Engineer International, 1997 ( 4 pages).

Mike Chambers, "Multi-Lateral Completions at Mobil Past, Present, and Future," presented at the 1998 Summit on E&P Drilling Technologies, Strategic Research Institute, Aug. 18-19, 1998 in San Antonio, Texas (26 pages).

David C. Oyler and William P. Diamond, "Drilling a Horizontal Coalbed Methane Drainage System From a Directional Surface Borehole," PB82221516, National Technical Information Service, Bureau of Mines, Pittsburgh, PA, Pittsburgh Research Center, Apr. 1982 (56 pages).

P. Corlay, D. Bossie-Codreanu, J.C. Sabathier and E.R. Delamaide, "Improving Reservoir Management With Complex Well Architectures," Field Production & Reservoir Management, World Oil, Jan. 1997 ( 5 pages).

Eric R. Skonberg and Hugh W. O'Donnell, "Horizontal Drilling for Underground Coal Gasification," presented at the Eighth Underground Coal Conversion Symposium, Keystone, Colorado, Aug. 16, 1982 ( 8 pages).

Gamal Ismail, A.S. Fada'q, S. Kikuchi, H. El Khatib, "Ten Years Experience in Horizontal Application & Pushing the Limits of Well Construction Approach in Upper Zakum Field (Offshore Abu Dhabi)," SPE 87284, Society of Petroleum Engineers, Oct. 2000 (17 pages).

Gamal Ismail, H. El-Khatib—ZADCO, Abu Dhabi, UAE, "Multi-Lateral Horizontal Drilling Problems & Solutions Experienced Offshore Abu Dhabi," SPE 36252, Society of Petroleum Engineers, Oct. 1996 (12 pages).

C.M. Matthews and L.J. Dunn, "Drilling and Production Practices to Mitigate Sucker Rod/Tubing Wear-Related Failures in Directional Wells," SPE 22852, Society of Petroleum Engineers, Oct. 1991 (12 pages).

H.H. Fields, Stephen Krickovic, Albert Sainato, and M.G. Zabetakis, "Degasification of Virgin Pittsburgh Coalbed Through a Large Borehole," RJ-7800, Bureau of Mines Report of Investigations/1973, United States Department of the Interior, 1973 (31 pages).

William P. Diamond, "Methane Control for Underground Coal Mines," IC-9395, Bureau of Mines Information Circular, United States Department of the Interior, 1994 (51 pages).

Technology Scene Drilling & Intervention Services, "Weatherford Moves Into Advanced Multilateral Well Completion Technology," *Reservoir Mechanics*, Weatherford International, Inc., 2000 Annual Report (2 pages).

"A Different Direction for CBM Wells," *W Magazine*, 2004 Third Quarter (5 pages).

Snyder, Robert E., "What's New in Production," *WorldOil Magazine*, Feb. 2005, [retrieved from the internet on Mar. 7, 2005], http://www.worldoil.com/magazine/MAGAZINE_DETAIL.asp?ART_ID=2507@MONTH_YEAR (3 pages).

Nazzal, Greg, "Moving Multilateral Systems to the Next Level," Strategic Acquisition Expands Weatherford's Capabilities, 2000 (2 pages).

Bahr, Angie, "Methane Draining Technology Boosts Safety and Energy Production,"Energy Review, Feb. 4, 2005, Website: www.energyreview.net/storyviewprint.asp, printed Feb. 7, 2005 (2 pages).

Molvar, Erik M., "Drilling Smarter: Using Directional Drilling to Reduce Oil and Gas Impacts in the Intermountain West," Prepared by Biodiversity Conservation Alliance, Report issued Feb. 18, 2003, 34 pages.

King, Robert F., "Drilling Sideways—A Review of Horizontal Well Technology and Its Domestic Application," DOE/EIA-TR-0565, U.S. Department of Energy, Apr. 1993, 30 pages.

Notification of Transmittal of the International Search Report and the Written Opinion of the International Searching Authority, or the Declaration (3 pages), International Search Report (3 pages), and Written Opinion of the International Searching Authority (5 pages) re International Application No. PCT/US2004/024518 mailed Nov. 10, 2004.

Schenk, Christopher J., "Geologic Definition and Resource Assessment of Continuous (Unconventional) Gas Accumulations—the U.S. Experience," Website, http://aapg.confes.com/. . .//, printed Nov. 16, 2004 ( 1 page).

U.S. Department of Interior, U.S. Geological Survey, "Characteristics of Discrete and Basin-Centered Parts of the Lower Silurian Regional Oil and Gas Accumulation, Appalachian Basin: Preliminary Results From a Data Set of 25 oil and Gas Fields," U.S. Geological Survey Open-File Report 98-216, Website, http://pubs.usgs.gov/of/1998/of98-216/introl.htm, printed Nov. 16, 2004 ( 2 pages).

Zupanick, J., "Coalbed Methane Extraction," 28th Mineral Law Conference, Lexington, Kentucky, Oct. 16-17, 2003 (48 pages).

Zupanick, J., "CDX Gas—Pinnacle Project," Presentation at the 2002 Fall Meeting of North American Coal Bed Methane Forum, Morgantown, West Virginia, Oct. 30, 2002 (23 pages).

Lukas, Andrew, Lucas Drilling Pty Ltd., "Technical Innovation and Engineering Xstrata—Oaky Creek Coal Pty Limited," Presentation at Coal Seam Gas & Mine Methane Conference in Brisbane, Nov. 22-23, 2004 (51 pages).

Field, Tony, Mitchell Drilling, "Let's Get Technical—Drilling Breakthroughs in Surface to In-Seam in Australia," Presentation at Coal Seam Gas & Mine Methane Conference in Brisbane, Nov. 22-23, 2004 (20 pages).

Zupanick, Joseph A, "Coal Mine Methane Drainage Utilizing Multilateral Horizontal Wells," 2005 SME Annual Meeting & Exhibit, Feb. 28-Mar. 2, 2005, Salt Lake City, Utah (6 pages).

The Official Newsletter of the Cooperative Research Centre for Mining Technology and Equipment, CMTE News 7, "Tight-Radius Drilling Clinches Award," Jun. 2001, 1 page.

Notification of Transmittal of the International Search Report and the Written Opinion of the International Searching Authority, or the Declaration (3 pages), International Search Report (5 pages) and Written Opinion of the International Searching Authority (6 pages) re International Application No. PCT/US2004/012029 mailed Sep. 22, 2004.

Brunner, D.J. and Schwoebel, J.J., "Directional Drilling for Methane Drainage and Exploration in Advance of Mining," REI Drilling Directional Underground, World Coal, 1999, 10 pages.

Thakur, P.C., "A History of Coalbed Methane Drainage From United States Coal Mines," 2003 SME Annual Meeting, Feb. 24-26, Cincinnati, Ohio, 4 pages.

U.S. Climate Change Technology Program, "Technology Options for the Near and Long Term," 4.1.5 Advances in Coal Mine Methane Recovery Systems, pp. 162-164.

Notification of Transmittal of the International Search Report and the Written Opinion of the International Searching Authority, or the Declaration (3 pages), International Search Report (3 pages) and Written Opinion of the International Searching Authority (7 pages) re International Application No. PCT/US2004/017048 mailed Oct. 21, 2004.

Gardes, Robert, "Multi-Seam Completion Technology," Natural Gas Quarterly, E&P, Jun. 2004, pp. 78-81.

Baiton, Nicholas, "Maximize Oil Production and Recovery," Vertizontal Brochure, received Oct. 2, 2002, 4 pages.

Dreiling, Tim, McClelland, M.L. and Bilyeu, Brad, "Horizontal & High Angle Air Drilling in the San Juan Basin, New Mexico," Dated on or about Mar. 6, 2003, pp. 1-11.

Fong, David K., Wong, Frank Y., and McIntyre, Frank J., "An Unexpected Benefit of Horizontal Wells on Offset Vertical Well Productivity in Vertical Miscible Floods," Canadian SPE/CIM/CANMET Paper No. HWC94-09, paper to be presented Mar. 20-23, 1994, Calgary, Canada, 10 pages.

Fischer, Perry A., "What's Happening in Production, " World Oil, Jun. 2001, p. 27.

Website of PTTC Network News vol. 7, 1st Quarter 2001, Table of Contents, http://www.pttc.org/. . /news/v7n1nn4.htm printed Apr. 25, 2003, 3 pages.

Cox, Richard J.W., "Testing Horizontal Wells While Drilling Underbalanced," Delft University of Technology, Aug. 1998, 68 pages.

McLennan, John, et al., "Underbalanced Drilling Manual," Gas Research Institute, Chicago, Illinois, GRI Reference No. GRI-97/0236, copyright 1997, 502 pages.

The Need for a Viable Multi-Seam Completion Technology for the Powder River Basin, Current practice and Limitations, Gardes Energy Services, Inc., Believed to be 2003 (8 pages).

Langley, Diane, "Potential Impact of Microholes Is Far From Diminutive," JPT Online, http://www.spe.org/spe/jpt/jps, Nov. 2004 (5 pages).

Consol Energy Slides, "Generating Solutions, Fueling Change," Presented at Applachian E&P Forum, Harris Nesbitt Corp., Boston, Oct. 14, 2004 (29 pages).

PowerPoint Presentation entitled, "Horizontal Coalbed Methane Wells," by Bob Stayton, Computalog Drilling Services, date is believed to have been in 2002 (39 pages).

Denney, Dennis, "*Drilling Maximum-Reservoir-Contact Wells in the Shaybah Field*," SPE 85307, pp. 60, 62-63, Oct. 20, 2003.

B. Goktas et al., "*Performances of Openhole Completed and Cased Horizontal/Undulating Wells in Thin-Bedded, Tight Sand Gas Reservoirs*, " SPE 65619, Society of Petroleum Engineers, Oct. 17-19, 2000 (7 pgaes).

Sharma, R., et al., "*Modelling of Undulating Wellbore Trajectories*," The Journal of Canadian Petroleum Technology, vol. 34, No. 10, XP-002261908, Oct. 18-20, 1993 pp. 16-24 (9 pages).

Balbinski, E.F., "*Prediction of Offshore Viscous Oil Field Performance*, " European Symposium on Improved Oil Recovery, Aug. 18-20, 1999, 10 pages.

Notification of Transmittal of the International Search Report or the Declaration (PCT Rule 44.1) (3 pages) and International Search Report (7 pages) re International Application No. PCT/US 03/04771 mailed Jul. 4, 2003.

Notification of Transmittal of the International Search Report or the Declaration (PCT Rule 44.1) (3 pages) and International Search Report (5 pages) re International Application No. PCT/US 03/21891 mailed Nov. 13, 2003.

Notification of Transmittal of the International Search Report or the Declaration (PCT Rule 44.1) (3 pages) and International Search Report (4 pages) re International Application No. PCT/US 03/38383 mailed Jun. 2, 2004.

Kalinin, et al., Translation of Selected Pages from Ch. 4, Sections 4.2 (p. 135), 10.1 (p. 402), 10.4 (pp. 418-419), "*Drilling Inclined and Horizontal Well Bores*," Moscow, Nedra Publishers, 1997, 4 pages.

Jet Lavanway Exploration, "*Well Survey*," Key Energy Surveys, Nov. 2, 1997, 3 pages.
Precision Drilling, "*We Have Roots in Coal Bed Methane Drilling*," Technology Services Group, Published on or before Aug. 5, 2002, 1 page.
U.S. Dept. of Energy, "*New Breed of CMB/CMM Recovery Technology*," Jul. 2003, 1 page.
Ghiselin, Dick, "*Unconventional Vision Frees Gas Reserves*," Natural Gas Quarterly, Sep. 2003, 2 pages.
CBM Review, World Coal, "*US Drilling into Asia*," Jun. 2003, 4 pages.
Skrebowski, Chris, "*US Interest in North Korean Reserves*," Petroleum, Energy Institute, Jul. 2003, 4 pages.
Platt, "Method and System for Lining Multilateral Wells," U.S. Appl. No. 10/772,841, filed Feb. 5, 2004 (30 pages).
Zupanick, "Three-Dimentsional Well System For Accessing Subterranean Zones," Feb. 11, 2004, U.S. Appl. No. 10/777,503, (27 pages).
Zupanick, "System And Method For Directional Drilling Utilizing Clutch Assembly," U.S. Appl. No. 10/811,118, filed Mar. 25, 2004 (35 pages).
Zupanick et al., "Slot Cavity," U.S. Appl. No. 10/419,529, filed Apr. 21, 2003 (44 pages).
Zupanick, "System and Method for Multiple Wells from a Common Surface Location," U.S. Appl. No. 10/788,694, filed Feb. 27, 2004 (26 pages).
Field, T.W., "*Surface to In-seam Drilling—The Australian Experience*," Undated, 10 pages.
Drawings included in CBM well permit issued to CNX stamped Apr. 15, 2004 by the West Virginia Department of Environmenal Protection (5 pages).
Website of Mitchell Drilling Contractors, "*Services: Dymaxion—Surface to In-seam*," http://www.mitchell drilling.com/dymaxion.htm, printed as of Jun. 17, 2004, 4 pages.
Website of CH4, "About Natural Gas—Technology," http://www.ch4.com.au/ng_technology.html, copyright 2003, printed as of Jun. 17, 2004, 4 pages.
Thomson, et al., "*The Application of Medium Radius Directional Drilling for Coal Bed Methane Extraction*," Lucas Technical Paper, copyrighted 2003, 11 pages.
U.S. Department of Energy, DE-FC26-01NT41148, "*Enhanced Coal Bed Methane Production and Sequestration of CO2 in Unmineable Coal Seams* " for Consol, Inc., accepted Oct. 1, 2001, 48 pages.
U.S. Department of Energy, "*Slant Hole Drilling*, " mar. 1999, 1 page.
Desai, Praful, et al., "*Innovative Design Allows Construction of Level 3 or Level 4 Junction Using the Same Platform*," SPE/Petroleum Society of CIM/CHOA 78965, Canadian Heavy Oil Association, 2002, pp. 1-11.
Bybee, Karen,"*Advanced Openhole Multilaterals*," Horizontal Wells, Nov. 2002, pp. 41-42.
Bybee, Karen, "*A New Generation Multilateral System for the Troll Olje Field*" Multilateral/Extended Reach, Jul. 2002, 2 pages.
Emerson,, A.B., et al., "*Moving Toward Simpler, Highly Functional Multilateral Completions*," Technical Note, Journal of Canadian Petroleum Technology, May 2002, vol. 41, No. 5, pp. 9-12.
Moritis, Guntis, "*Complex Well Geometries Boost Orinoco Heavy Oil Producing Rates*," XP-000969491, Oil & Gas Journal, Feb. 28, 2000, pp. 42-46.
Themig, Dan, "*Multilateral Thinking*," New Technology Magazine, Dec. 1999, pp. 24-25.
Smith, R.C., et al., "*The Lateral Tie-Back System: The Ability to Drill and Case Multiple Laterals*," IADC/SPE 27436, Society of Petroleum Engineers, 1994, pp. 55-64, plus Multilateral Services profile (1 page0 and Multilateral Services Specifications (1 page).
Notification of Transmittal of the International Search Report or the Declaration (PCT Rule 44.1) (3 pages) and International Search Report ( 4 pages) re International Application No. PCT/US 03/13954 mailed Sep. 1, 2003.
Logan, Terry L., "*Drilling Techniques for Coalbed Methane*," Hydrocarbons From Coal, Chapter 12, Copyright 1993, Title Page, Copyright page, pp. 269-285.
Hanes, John, "*Outbursts in Leichhardt Colliery: Lessons learned*," International Symposium-Cum-Workshop on Management and Control of High Gas Emissions and Outbursts in Underground Coal Mines, Wollongong, NSW, Australia, Mar. 20-24, 1995, Title page, pp. 445-449.
Williams, Ray, et al., "*Gas Reservoir Properties for Mine Gas Emission Assessment*," Bowen Basin Symposium 2000, pp. 325-333.
Brown, K., et al., "*New South Wales Coal Seam Methane Potential*," Petroleum Bulletin 2, Department of mIneral Resources, Discovery 2000, Mar. 1996, pp. i-viii, 1-96.
Fipke, S., et al., "*Economical Multilateral Well Technology for Canadian Heavy Oil*," Petroleum Society, Canadian Institute of Mining, Metallurgy & Petroleum, Paper 2002-100, to be presented in Calgary Alberta, Jun. 11-13, 2002, pp. 1-11.
Notification of Transmittal of the International Search Report or the Declaration (PCT Rule 44.1) mailed Feb. 9, 2004 (6 pages) re International Application No. PCT/US 03/28138.
Notification of Transmittal of the International Search Report or the Declaration (PCT Rule 44.1) mailed Feb. 27, 2004 (9 pages) re International Application No. PCT/US 03/30126.
Fletcher, "Anadarko Cuts Gas Route Under Canadian River Gorge," Oil and Gas Journal, pp. 28-30.
Translation of selected pages of Kalinin, et al., "Drilling Inclined and Horizontal Well Bores," Nedra Publishers, Moscow, 1997, 15 pages.
Translation of selected pages of Arens, V.Zh., "Well-Drilling Recovery of Minerals," Geotechnology, Nedra Publishers, Moscow, 7 pages, 1986.
Examiner of Record, Office Action Response regarding the Interpretation of the three Russian Patent Applications listed above under Foreign Patent Documents (9 pages), date unknown.
McCray and Cole, "Oil Well Drilling and Technology," University of Oklahoma Press, pp. 315-319, 1959.
Berger and Anderson, "Modern Petroleum;" Penn Well Books, pp. 106-108, 1978.
Arfon H. Jones et al., A Review of the Physical and Mechanical Properties of Coal with Implications for Coal-Bed Methane Well Completion and Production, Rocky Mountain Association of Geologists, pp. 169-181, 1988.
Howard L. hartman, et al.; "SME Mining Engineering Handbook;" Society for Mining, Metallurgy, and Exploration, Inc., pp. 1946-1950, 2nd Edition, vol. 2, 1992.
Dave hassan, Mike Chemichen, Earl jensen, and Morley Frank; "Multi-lateral technique lowers drilling costs, provides environmental benefits", Drilling Technology, pp. 41-47, Oct. 1999.
Gopal Ramaswamy, "Production History Provides CBM Insights," Oil & Gas Journal, pp. 49, 50 and 52, Apr. 2, 2001.
Weiguo Chi and Luwu yang, "Feasibility of Coal bed Methane Exploitation in China," Horizontal Well Technology, p. 74, Sep. 2001.
Nackerud Product Description, harvest Tool Company, LLC, 1 page, Received Sep. 27, 2001.
Gopal Ramaswamy, "Advanced Key for Coalbed Methane," The American Oil & Gas Reporter, pp. 71 & 73, Oct. 2001.
Joseph C. Stevens, horizontal Applications For Coal Bed Methane Recovery, Strategic Research Institute, pp. 1-10 (slides), Mar. 25, 2002.
R.J. "Bob" Stayton, "Horizontal Wells Boost CBM Recovery", Special Report: Horizontal & Directional Drilling, The American Oil & Gas Reporter, pp. 71-75, Aug. 2002.
P. Jackson and S. Kershaw, Reducing Long Term Methane Emissions Resulting from Coal Mining, Energy Convers. Mgmt, vol. 37, Nos. 6-8, pp. 801-806, 1996.
Susan Eaton, "Reversal of Fortune", New Technology Magazine, pp. 30-31, Sep. 2002.
James Mahony, "A Shadow of Things to Come", New Technology Magazine, pp. 28-29, Sep. 2002.
Documents Received from Third Party, Great Lakes Directional Drilling, Inc., (12 pages), Received Sep. 12, 2002.
Robert W. Taylor and Richard Russell, Multilateral Technologies Increase Operational Efficiencies in Middle East, Oil & Gas Journal, pp. 76-80, Mar. 16, 1998.

Adam Pasiczynk, "Evolution Simplifies Multilateral Wells", Directional Drilling, pp. 53-55, Jun. 2000.
Steven S. Bell, "Multilateral System with Full Re-Entry Access Installed", World Oil, p. 29, Jun. 1996.
Pascal Breant, "Des Puits Branches, Chez Total : les puits multi drains", total Exploration Production, pp. 1-5, Jan. 1999.
Chi, Weiguo, "*Feasible Discussion on Exploitation Coalbed Methane through Horizontal Network Drilling in China*", SPE 64709, Society of Petroleum Engineers (SPE International), 4 pages, Nov. 7, 2000.
chi, Weiguo, "*Feasibility of Coalbed Methane Exploitation in China*", synopsis of paper SPE 64709, 1 page, Nov. 7, 2000.
Ian D. Palmer et al., "*Coalbed Methane Well Completions and Stimulations*", Chapter 14, pp. 303-339, Hydrocarbons from Coal, Published by the American Association of Petroleum Geologists, 1993.
Zupanick, U.S. Appl. No. 10/264,535, "Method and System for Removing Fluid From a Subterranean Zone Using an Enlarged Cavity", Aug. 15, 2003.
Notification of Transmittal of the International Search Report or the Declaration (PCT Rule 44.1) mailed Nov. 6, 2003 (8 pages) re International Application No. PCT/US 03/21626, Jul. 11, 2003.
Notification of Transmittal of the International Search Report or the Declaration (PCT Rule 44.1) mailed Nov. 5, 2003 (9 pages) re International Application No. PCT/US 03/21627, Jul. 11, 2003.
Notification of Transmittal of the International Search Report or the Declaration (PCT Rule 44.1) mailed Nov. 4, 2003 97 pages) re International Application No. PCT/US 03/21628, Jul. 11, 2003.
Notification of Transmittal of the International Search Report or the Declaration (PCT Rule 44.1) mailed Dec. 5, 2003 (8 pages) re International Application No. PCT/US 03/21750, Jul. 11, 2003.
Notification of Transmittal of the International Search Report or the Declaration (PCT Rule 44.1) mailed Dec. 19, 2003 (8 pages) re International Application No. PCT/US 03/28137, filed Sep. 9, 2003.
Notification of Transmittal of the International Search Report or the Declaration (PCT Rule 44.1) mailed Feb. 4, 2004 (8 pages) re International Application No. PCT/US 03/26124, filed Sep. 9, 2003.
Smith, Maurice, "*Chasing Unconventional Gas Unconventionally*," CBM Gas Technology, New Technology Magazine, Oct./Nov. 2003, pp. 1-4.
Gardes, Robert "*A New Direction in Coalbed Methane and Shale Gas Recovery*," (to the best of Applicants' recollection, first received at The Canadian Institute Coalbed Methane Symposium conference on Jun. 16 and Jun. 17, 2002), 1 page of conference flyer, 6 pages of document.
Gardes, Robert, "*Under-Balance Multi-Lateral Drilling for Unconventional Gas Recovery*," (to the best of Applicants' recollection, first received at The Unconventional Gas Revolution conference on Dec. 9, 2003, 4 pages of conference flyer, 33 pages of document.
Boyce, Richard "*High Resolution Selsmic Imaging Programs for Coalbed Methane Development*," (to the best of Applicants' recollection, first received at The Unconventional Gas Revolution conference on Dec. 10, 2003), 4 pages of conference flyer, 24 pages of document.
Mark Mazzella and David Strickland, "*Well Control Operations on a Multiwell Platform Blowout*," WorldOil.com—Online Magazine Article, vol. 22, Part I-pp. 1-7, and Part II-pp. 1-13, Jan. 2002.
Vector Magnetics LLC, Case history, California, May 1999, "*Successful Kill of a Surface Blowout*," pp. 1-12.
Cudd Pressure Control, Inc, "*Successful Well Control Operations-A Case Study: Surface and Subsurface Well Intervention on a Multi-Well Offshore Platform Blowout and Fire*," pp. 1-17, http://www.cuddwellcontrol.com/literature/successful/successful_well.htm, 2000.
R. Purl, et al., "*Damage to Coal Permeability During Hydraulic Fracturing*" pp. 109-115 (SPE 21813), 1991.
U.S. Dept. of Energy—Office of Fossil Energy, "*Multi-Seam Well Completion Technology: Implications for Powder River Basin Coalbed Methane Production*," pp. 1-100, A-1 through A10, Sep. 2003.
U.S. Dept. of Energy—Office of Fossil Energy, "*Powder River Basin Coalbed Methane Development and Produced Water Management Study*," pp. 1-111, A-1 through A14, Sep. 2003.
Zupanick, entitled "Method and System for Underground Treatment of Materials," U.S. Appl. No. 10/142,817, May 8, 2002.
Zupanick, entitled "Multi-Well Structure for Accessing Subterranean Deposits," U.S. Appl. No. 09/788,897, Feb. 20, 2001.
Zupanick, entitled "Slant Entry Well System and Method," U.S. Appl. No. 10/004,316, Oct. 30, 2001.
Zupanick, entitled "Undulating Well Bore", U.S. Appl. No. 10/194,366, Jul. 12, 2002.
Zupanick, entitled "Accelerated Production of Gas from a Subterranean Surface", U.S. Appl. No. 10/246,052, Sep. 17, 2002.
Zupanick, entitled "Ramping Well Bores", U.S. Appl. No. 10/194,367, Jul. 12, 2002.
Zupanick, entitled "System and Method for Subterranean Access", U.S. Appl. No. 10/227,057, Aug. 22, 2002.
Zupanick, entitled "Method and System for Controlling Pressure in a Dual Well System", U.S. Appl. No. 10/244,082, Sep. 12, 2002.
Zupanick, entitled "Wellbore Sealing System and Method," U.S. Appl. No. 10/194,368, Jul. 12, 2002.
Zupanick, entitled "Wellbore Sealing System and Method," U.S. Appl. No. 10/194,422, PUBLISHED Jul. 12, 2002.
Zupanick, entitled "Three-Dimensional Well System for Accessing Subterranean Zones," U.S. Appl. No. 10/244,083, Sep. 12, 2002.
Zupanick, entitled "Method of Drilling Lateral Wellbores from a Slant Well Without Utilizing a Whipstock", U.S. Appl. No. 10/267,426, Oct. 8, 2002.
Zupanick, entitled "Method and System for Circulating Fluid in a Well System", U.S. Appl. No. 10/323,192, Dec. 18, 2002.
Zupanick, entitled "Method and System for Removing Fluid from a Subterranean Zone Using and Enlarged Cavity", U.S. Appl. No. 10/264,535, Oct. 3, 2002.
Zupanick, entitled Method and System for Controlling the Production Rate . . . , U.S. Appl. No. 10/328,408, Dec. 23, 2002.
Rial, entitled Method and System for Accessing a Subterranean Zone from a Limited Surface Area, U.S. Appl. No. 10/188,141, Jul. 1, 2002.
Zupanick, entitled "Three-Dimensional Well System for Accessing Subterranean Deposits from the Surface and Tools Therefor," U.S. Appl. No. 10/630,345, Jul. 29, 2003.
Zupanick, entitled "Method and System for Testing Paritally Formed Hydrocarbon Well for Evaluation and Well Planning Refinement," U.S. Appl. No. 10/715,300, Nov. 17, 2003.
Rial, entitled "method and System for Recirculating Fluid in a Well System," U.S. Appl. No. 10/457,103, Jun. 5, 2003.
Zupanick, entitled "Wellbore Sealing System and Method," U.S. Appl. No. 10/406,037, Published Jul. 12, 2002.
Seams, entitled "Method and System for Extraction of Resources from a Subterranean Well Bore," U.S. Appl. No. 10/723,322, Nov. 26, 2003.
Zupanick, entitled "Method and System for Accessing Subterranean Deposits from the Surface," U.S. Appl. No. 10/641,856, Aug. 15, 2003.
Zupanick, entitled "Slant Entry Well System and method," U.S. Appl. No. 10/749,884, Dec. 31, 2003.
Zupanick, entitled Method and System for Accessing a Subterranean Deposits for the Surface, U.S. Appl. No. 10/761,629, Jan. 20, 2004.
Notification of Transmittal of the International Preliminary Report of patentability (1 page) and International Preliminary Report on Patentability (12 pages) mailed Jan. 9, 2006 for International Application No. PCT/US2004/036616.
Notification Concerning Transmittal of Copy of International Preliminary Report on Patentability (Chapter 1 of the Patent Cooperation Treaty) (1 page), International Preliminary Report on Patentability (1 page), and Written Opinion of the International Searching Authority (7 pages mailed Dec. 22, 2005 for International Application No. PCT/US2004/017048.
European Search and Examination Report, completed Dec. 5, 2005 for Application Number EP 05020737, 5 pages.
P.C. Thakur and W.N. Poundstone, "*Horizontal Drilling Technology for Advance Degasification*," Society of Mining Engineers of AIME, Preprint No. 79-113, For presentation at the 1979 AIME Annual Meeting, New Orleans, Lousiana, Feb. 18-22, 1979, Engineering Societies Library stamp dated Feb. 5, 1980, 11 pages.

Notification Concerning Transmittal of Copy of International Preliminary Report on Patentability (1 page), International Preliminary Report on Patentability (1 page), and Written Opinion of the International Searching Authority (5 pages) mailed Feb. 9, 2006 for International Application No. PCT/US2004/024518.

Wang Weiping, "*Trend of Drilling Technology Abroad*," Petroleum Drilling and Production Technology, 1995 (vol. 17), Issue 6, www.cnki.net, 8 pages, translation, original in Chinese.

Tver, David, *The Petroleum Dictionary*, 1980, p. 221.

Rennick, et al., "*Demonstration of Safety Plugging of Oil Wells Penetrating Appalachian Coal Mines*," Bureau of Mines Coal Mine Health and Safety Research Program, Technical Progress Report—56, U.S. Department of the Interior, Jul. 1972, 25 pages.

George N. Aul and Joseph Cervik, "Grouting Horizontal Drainage Holes in Coalbeds," RI 8375, Bureau of Mines Report of Investigations, U.S. Department of the Interior, 1979, 21 pages.

Paul J. Componation, et al., "*Cleaning Out, Sealing and Mining Through Wells Penetrating Areas of Active Coal Mines in Northern West Virginia*," MESA Information Report 1052, U.S. Department of the Interior, 1977, 26 pages.

George S. Rice, "*Notes on the Prevention of Dust and Gas Explosions in Coal Mines*," Technical Paper 56, Bureau of Mines, Department of the Interior, copyright 1913, 12 pages.

George S. Rice, et al., "*Oil and Gas Wells Through Workable Coal Beds*," Bulletin 65, Petroleum Technology 7, Bureau of Mines, Department of the Interior, copyright 1913, 54 pages.

Notification of Transmittal of the International Preliminary Report on Patentability (1 page) and International Preliminary Report on Patentability (8 pages) for International Application No. PCT/US2005/002162 mailed May 3, 2006.

D. Nathan Meehan, "*Technology Vital For Horizontal Well Success*," Oil & Gas Journal, Dec. 11, 1995, 8 pages.

B.A. Tarr, A.F. Kuckes and M.V. Ac, "*Use of New Ranging Tool To Position a Vertical Well Adjacent to a Horizontal Well*," SPE Drilling Engineering, Jun. 1992, 7 pages.

William J. McDonald, Ph.D., John H. Cohen, and C. Mel Hightower, "*New Lightweight Fluids for Underbalanced Drilling*," believed to be on or about 1998, 10 pages.

Philip C. Crouse, "*Application and Needs for Advanced Multilateral Technologies and Strategies*," Website: www.netl.doe.gov/publications/proceedings/97/97ng/ng97_pdf/NG2-5.pdf; Believed to be on or about 1997, 9 pages.

Dan Themig, "*Multi-Laterals Providing New Options*," The American Oil & Gas Reporter, V. 39, No. 7, Jul. 1996, 4 pages.

Daniel D. Gleltman, "*Integrated underbalanced Directional Drilling System*," Interim Rport for Period of Performance Oct. 1, 1995-Feb. 14, 1996, DOE FETC Contract DE-AC21-95MC31103, Mar. 1997, 23 pages.

J.D. Gallivan, N.R. Hewitt, M. Olsen, J.M. Peden, D. Tehrani and A.A.P. Tweedie, "*Quantifying the Benefits of Multi-Lateral Producing Wells*," SPE 30441, Society of Petroleum Engineers, Inc., Copyright 1995, 7 pages.

C.A. Ehlig-Economides, G.R. Mowat and C. Corbett, "*Techniques for Multibranch Well Trajectory Design in the Context of a Three-Dimensional Reservoir Model*," SPE 35505, Society of Petroleum Engineers, Copyright 1996, 8 pages.

Stephen R. Dittoe, Albertus Retnanto, and Michael j. Economides, "*An Analysis of Reserves Enhancement in Petroleum Reservoirs with Horizontal and Multi-Lateral Wells*," SPE 37037, Society of petroleum Engineers, Copyright 1996, 9 pages.

D.L. Boreck and M.T. Strever, "*Conservation of Methane from Colorado's Mined/Minable Coal Beds: A Feasibility Study*," Open-File Report 80-5, Colorado Geological Survey, Department of Natural Resources, Denver, Colorado, Oct. 1980, 101 pages.

B.G. kta and T. Ertekin, "*Implementation of a Local Grid Refinement Technique in Modeling Slanted, Undulating Horizontal and Multi-Lateral Wells*," SPE 56624, Society of Petroleum Engineers, Copyright 1999, 10 pages.

W.H. Leach Jr., "*New Technology for CBM Production*," Oil and Gas Investor, Opportunities in Coalbed Methane, Dec. 2002, 6 pages.

David Wagman, "*CBM Investors Keep Their Guard Up*," Oil and Gas Investor, Opportunities in Coalbed Methane, Dec. 2002, 5 pages.

Stephen D. Schwochow, "*CBM: Coming to a Basin Near You*," Oil and Gas Investor, Opportunities in Coalbed Methane, Dec. 2002, 7 pages.

"*White Paper: Guidebook on Coalbed Methane Drainage for Underground Coal Mines*," paper prepared under U.S. Environmental Protection Agency Cooperative Agreement No. CX824467-01-0 with The Pennsylvania State University by Jan M. Mutmansky, Apr. 1999, 50 pages.

M.G. Zabetakis, maurice Deul, and M.L. Skow, "*Methane Control in United States Coal mines—1972*," Information Circular 8600, United States Department of the Interior, Bureau of Mines Information Circular/1973, 26 pages.

B. Goktas, "*A Comparative Analysis of the Production Characteristics of Cavity Completions and Hydraulic Fractures in Coalbed Methane Reservoirs*," Society of Petroleum Engineers, SPE 55600, Copyright 1999, 10 pages.

William P. Diamond and David C. Oyler,"*Drilling Long Horizontal Coalbed Methane Drainage Holes from a Directional Surface Borehole*," Society of Petroleum Engineers, SPE/DOE 8968, 1980, 6 pages.

Turgay Ertekin, Wonmo Sung, and Fred C. Schwerer, "*Production Performance Analysis of Horizontal Drainage Wells for the Degasification of Coal Seams*," Journal of Petroleum Technology, May 1988, 8 pages.

Patrick B. Tracy, "*Lateral Drilling Technology Tested on UCG Project*," IADC/SPE 17237, IADC/SPE Drilling Conference, Copyright 1988, 10 pages.

P.S. Sarkar and J.M. Rajtar, "*Transient Well Testing of Coalbed methane Reservoirs With Horizontal Wells*," SPE 27681, Society of Petroleum Engineers, Copyright 1994, 9 pages.

R.A. Schraufnagel, D.G. Hill and R.A. McBane, "*Coalbed Methane—A Decade of Success*," SPE 28581, Society of Petroleum Engineers, Copyright 1994, 14 pages.

J.R. Kelafant, C.M. Boyer, and M.D. Zuber, "*Production Potential and Strategies for Coalbed methane in the Central Appalachian Basin*," SPE 18550, Society of Petroleum Engineers, Copyright 1988, 8 pages.

Ian Palmer, John McLennan, and Mike Kutas, "*Completions and Stimulations for Coalbed Methane Wells*," SPE 30012, Society of Petroleum Engineers, Copyright 1995, 13 pages.

John E. Jochen and Bradley M. Robinson, "*Survey of Horizontal Gas Well Activity*," SPE 35639, Society of Petroleum Engineers, Copyright 1996, 5 pages.

R.G. Jeffrey, J.R. Enever, J.H. Wood, J.P. Connors, S.K. Choi, K.T.A. Meaney, D.A. Casey, and R.A. Koenig, "*A Stimulation and Production Experiment in a Vertical Coal Seam Gas Drainage Well*," SPE 36982, Society of Petroleum Engineers, Copyright 1996, 7 pages.

Matt C. Rowan and Michael J. Whims, "*Multilateral Well Enhances Gas Storage Deliverability*," Oil & Gas Journal, Dec. 25, 1995, 4 pages.

Dan Themig, "*Planning and Evaluation are Crucial to Multilateral Wells*," Petroleum Engineer International, Jan. 1996, 3 pages.

Larry Comeau, Randy Pustanyk, Ray Smith and Ian Gilles, "*Lateral Tie-Back System Increases Reservoir Exposure*," World Oil, Jul. 1995, 5 pages.

J. Smith, M.J. Economides and T.P. Frick, "*Reducing Economic Risk in Areally Anisotropic Formations With Multiple-Lateral Horizontal Wells*," SPE 30647, Society of Petroleum Engineers, Copyright 1995, 14 pages.

Scott Thomson, Andrew Lukas, and Duncan McDonald, "*Maximising Coal Seam Methane Extraction through Advanced Drilling Technology*," Lucas, Technical Paper, Second Annual Australian Coal Seam & Mine Methane Conference, Feb. 19-20, 2003, 14 pages.

William P. Diamond and David C. Oyler, "*Directional Drilling for Coalbed Degasification in Advance of Mining*" Proceedings of the 2nd Annual Methane Recovery from Coalbeds Symposium, Apr. 18-20, 1979, 17 pages.

John L. Stalder, Gregory D. York, Robert J. Kopper, Carl M. Curtis and Tony L. Cole, and Jeffrey H. Copley, "*Multilateral-Horizontal Wells Increase Rate and Lower Cost Per Barrel in the Zuata Field, Faja, Venezuela*," SPE 69700, Society of Petroleum Engineers, Copyright 2001, 9 pages.
Brent Lowson, "*Multilateral-Well Planning*," Synopsis of SPE 39245, JPT, Jul. 1998, 4 pages.
A. Njaerheim, R. Rovde, E. Kvale, S.A. Kvamme, and H.M. Bjoerneli, "*Multilateral Well in Low-Productivity Zones*," Synopsis of SPE 39356, JPT, Jul. 1998, 4 pages.
S.W. Bokhari, A.J. Hatch, A. Kyei, and O.C. Werngren, "*Improved Recovery from Tight Gas Sands with multilateral Drilling*," Synopsis of SPE 38629, JPT, Jul. 1998, 4 pages.
S.K. Vij, S.L. Narasaiah, Anup Walia, and Gyan Singh, "*Adopting Multilateral Technology*," Synopsis of SPE 39509, JPT, Jul. 1998, 3 pages.
William P. Diamond, David C. Oyler, and herbert H. Fields, "*Directionally Controlled Drilling to Horizontally Intercept Selected Strata, Upper Freeport Coalbed, Green County, PA*," Bureau of Mines Report of Investigations/1977, RI 8231, 1977, 25 pages.
David C. Oyler, William P. Diamond, and Paul W. Jeran, "*Directional Drilling for Coalbed Degasification*," Program Goals and Progress in 1978, Bureau of Mines Report of Investigations/1979, RI 8380, 1979, 17 pages.
United States Department of the Interior, "*Methane Control Research: Summary of Results, 1964-80*," Bureau of Mines Bulletin, Bulletin 687, 1988, 188 pages.
EPA, "*Identifying Opportunities for Methane Recovery at U.S. Coal Mines: Profiles of Selected Gassy Undergroung Coal Mines 1997-2001*," EPA Publication EPA 430-K-04-003, Jul. 2004, 202 pages.
Marshall DeLuca, "*Multilateral Completions on the Verge of Mainstream*," OFFSHORE, Apr. 1997, 2 pages.
Bob Williams, "*Operators Unlocking North Slope's Viscous Oil Commerciality*," Oil & Gas Journal, Aug. 6, 2001, 5 pages.
James P. Oberkircher, "*The Economic Viability of Multilateral Wells*," IADC/SPE 59202, Society of Petroleum Engineers, Copyright 2000, 10 pages.
Jim Oberkircher, "*What is the Future of Multilateral Technology?*," World Oil, Jun. 2001, 3 pages.
Rick Von Flatern, "*Operators Are Ready For More Sophisticated Multilateral Well Technology*," Petroleum Engineer International, Jan. 1996, 4 pages.
Kyle S. Graves, "*Multiple Horizontal Drainholes Can Improve Production*," Oil & Gas Journal, OGJ Special, Feb. 14, 1994, 5 pages.
Guntis, Moritis, "*Sincor Nears Upgrading, Plateau Production Phase*," Oil & Gas Journal, Oct. 29, 2001, 1 page.
Guntis Moritis, "*Smart, Intelligent Wells*," Oil & Gas Journal, Apr. 2, 2001, 6 pages.
Craig Coull, "*Intelligent Completion Provides Savings for Snorre TLP*," Oil & Gas Journal, Apr. 2, 2001, 2 pages.
D.T. Vo and M.V. Madden, "*Performance Evaluation of Trilateral Wells: Field Examples*," SPE 28376, Society of Petroleum Engineers, copyright 1994, 16 pages.
Dean E. Gaddy, "*Pioneering Work, Economic Factors Provide Insights Into Russian Drilling Technology*," Oil & Gas Journal, Jul. 6, 1998, 3 pages.
"*Optimal Multilateral-Well Design for a heavy-Oil Reservoir*," Synopsis of SPE 37554 by D.W. Boardman, JPT, Jul. 1997, 3 pages.
"*Multilateral-Well Completion-System Advances*," Synopsis of SPE 39125 by J.R. Longbottom et al., JPT, Jul. 1997, 3 pages.
"*Optimal Multilateral/Multibranch Completions*," Synopsis of SPE 38033 by Hironori Sugiyama et al., JPT, Jul. 1997, 5 pages.
"*Multilateral Experiences: IDD El Shargi North Dome Field (QATAR)*," Synopsis of SPE 37675 by J.R. Scofield et al., JPT, Jul. 1997, 3 pages.
"*Moving Toward the 'Intelligent Well'*," Synopsis of SPE 39126 by Clark E. Robison, JPT, Jul. 1997, 3 pages.
"*Short-Radius Laterals: An Operator's Experience*," Synopsis of SPE 37493 by C. Ellis et al., JPT, Jul. 1997, 3 pages.
"*Analyzing a Multilateral-Well Failure*," Synopsis of SPE 38268 by A. Ray Brister, JPT, Jul. 1997, 3 pages.
"*A New Concept for Multibranch Technology*," Synopsis of SPE 39123 by Mark Stracke et al., JPT, Jul. 1997, 3 pages.
"*Classification Clarifies Multilateral Options*," Synopsis of SPE 38493 by C. Hogg, JPT, Jul. 1997, 3 pages.
"*Infill Development With Multilateral-Well Technology*" Synopsis of SPE 38030 by Sau-Wai Wong et al., JPT, Jul. 1997, 3 pages.
Brad Califf and Denny Kerr, "*UPRC Completes First Quad-Lateral Well*," Petroleum Engineer International, Sep. 1993, 4 pages.
Jack Winton, "*Use of Multi-lateral Wells to Access marginal Reservoirs*," Offshore, Feb. 1999, 3 pages.
J.R. Salas, P.J. Clifford and D.P. Jenkins, "*Brief: Multilateral Well Performance Prediction*," JPT, Sep. 1996, 3 pages.
Mike R. Chambers, "*Multilateral Technology Gains Broader Acceptance*," Oil & Gas Journal, Nov. 23, 1998, 5 pages.
S. Ikeda, T. Takeuchi, and P.C. Crouse, "*An Investigative Study on Horizontal Well and Extended Reach Technologies With Reported problem Areas and Operational Practice in North America and Europe*," IADC/SPE 35054, Society of Petroleum Engineers, Copyright 1996, 8 pages.
Greg Nazzal, "*Extended-Reach Wells Tap Outlying Reserves*," World Oil, Mar. 1993, 8 pages.
Bambang Tjondrodiputro, Harry Eddyarso and kim Jones, "*How ARCO Drills High-Angle Wells Offshore Indonesia*," World Oil, Mar. 1993, 11 pages.
S. Hovda, et al., "*World's First Application of a Multilateral System Combining a Cased and Cemented Junction With Fullbore Access to both laterals*," SPE 36488, Society of Petroleum Engineers, Copyright 1996, 15 pages.
Robert A. Gardes, "*Micro-annulus Under-balanced Drilling of Multilateral Wells*," OFFSHORE, may 1996, 4 pages.
Brent Lowson, "*Phillips Multilateral Features Several Firsts for North Sea*," OFFSHORE, Feb. 1997, 2 pages.
J.R. Scofield, B. Laney and P. Woodard, "*Field Experience With Multi-Laterals in the Idd El Shargi North Dome Field(Qatar)*," SPE/IADC 37675, Society of Petroleum Engineers, Copyright 1997, 11 pages.
Jeremy Beckman, "*Coiled Tubing, Reamer Shoes Push Through Barriers in North Sea Wells*," OFFSHORE, Feb. 1997, 1 page.
C.H. Fleming, "*Comparing Performance of Horizontal Versus Vertical Wells*," World Oil, Mar. 1993, 7 pages.
Larry A. Cress and Stephen W. Miller, "*Dual Horizontal Extension Drilled Using Retrievable Whipstock*," World Oil, Jun. 1993, 9 pages.
Guntis Moritis, "*Heavy Oil Expansions Gather Momentum Worldwide*," Oil & Gas Journal, Aug. 14, 1995, 6 pages.
K.W. Hart and L.V. Jankowski, "*The Application of Slant Hole Drilling in Development of Shallow Heavy Oil Deposits*," The Journal Of Canadian Petroleum Technology, Jan.-Feb. 1984, Montreal, 6 pages.
Jeff Smith and Bob Edwards, "*Slant Rigs Offer Big Payoffs in Shallow Drilling*," Oil & Gas Journal, Mar. 30, 1992, 3 pages.
Ravil Gabdullinovich Salikhov, Evgeny Fedyorovich Dubrovin, and Vladimir Vladimirovich Sledkov, "*Cluster and Dual-Lateral Drilling Technologies Optimize Russian Well Production*," Oil & Gas Journal, Nov. 24, 1997, 7 pages.
Dean E. Gaddy, "*Inland Barge to Allow Cluster Drilling in Nigeria*," Oil & Gas Journal, Aug. 30, 1999, 7 pages.
Cliff Hogg, "*Comparison of Multilateral Completion Scenarios and Their Application*," SPE 38493, Society of Petroleum Engineers, Copyright 1997, 11 pages.
S.W. Bokhari, A.J. hatch, A. Kyei and O.C. Wemgren, "*Improved Recoveries in the Pickerill Field from Multilateral Drilling into Tight Gas Sands*," SPE 38629, Society of Petroleum Engineers, Copyright 1997, 15 pages.
J.R. Longbottom, Dana Dale, Kevin Waddell, Scott Bruha, and John Roberts, "*Development, Testing, and Field Case histories of Multilateral Well Completion Systems*," SPE 36994, Society of Petroleum Engineers, Copyright 1996, 16 pages.
E.J. Antczak, D.G.L. Smith, D.L. Roberts, Brent Lowson, and Robert Norris, "*Implementation of an Advanced Multi-Lateral System With Coiled Tubing Accessibility*," SPE/IADC 37673, Society of Petroleum Engineers, Copyright 1997, 9 pages.

H. Azoba, O. Akinmoladun, H. Rothenhofer, D. Kent and N. Nawfal, "*World Record Dual-and Tri-lateral Wells*," SPE/IADC 39240, Society of Petroleum Engineers, Copyright 1997, 6 pages.
R.W. Taylor and Rick Russell, "*Case Histories: Drilling and Completing Multilateral Horizontal Wells in the Middle East*," SPE/IADC 39243, Society of Petroleum Engineers, Copyright 1997, 14 pages.
D.K. Triolo and R.A. Mathes, "*Review of a Multi-Lateral Drilling and Stimulation Program*," SPE/IADC 39242, copyright 1997, Society of Petroleum Engineers, 13 pages.
John H. Perry, Leonard J. Prosser, Jr., Joseph Cervik, "*Methane Drainage from the mary Lee Coalbed, Alabama, using Horizontal Drilling Techniques*," SPE/DOE 8967, Society of Petroleum Engineers, may 18, 1980, 6 pages.
Gerald l. Finfinger, leonard J. Prosser, and Joseph Cervik, "*Influence of Coalbed Characteristics and Geology on Methane Drainage*," SPE/DOE 8964, Society of Petroleum Engineers, May 18, 1980, 6 pages.
Hilmer Von Schonfeldt, B. Rao Pothini, George N. Aul and Roger L. Henderson, "*Production adn utilization of Coalbed Methane Gas in Island Creek Coal Company Mines*," SPE/DOE 10817, Society of Petroleum Engineers, May 16, 1982, 10 pages.
Joseph Cervik, H.H. Fields, and G.N. Aul, "*Rotary Drilling Holes in Coalbeds for Degasification*," Ri 8097, Bureau of Mines Reporting of Investigations, 1975, 26 pages.
D.G. Masszi and A.A. Kahil, "*Coal Demethanation Principles and Field Experience*," The Journal Of Canadian Petroleum Technology, Jul.-Aug. 1982, 4 pages.
Tobias W. Goodman, Joseph Cervik, and George N. Aul, "*Degasification Study From an Air Shaft in the Beckley Coalbed*," RI 8675, Bureau of Mines Report of Investigations, 1982, 23 pages.
P.C. Thakur adn H.D. Dahl, "*Horizontal Drilling—A Tool for Improved Productivity*," Mining Engineering, Mar. 1982, 3 pages.
P.C. Thakur and J.G. Davis II, "*How to Plan for Methane Control in Underground Coal Mines*," Mining Engineering, Oct. 1977, 5 pages.
A.B. Yost II and B.H. Javins, "*Overview of Appalachian Basin High-Angle and Horizontal Air and Mud Drilling*," SPE 23445, Society of Petroleum Engineers, Oct. 22, 1991, 14 pages.
Pramod C. Thakur, "*Methane Flow in the Pittsburgh Coal Seam*," Third International Mine Ventilation Congress, England, U.K., Jun. 13-19, 1984, 17 pages.
Chapter 10 by Pramod C. Thakur, "*Methane Control for Longwall Gobs*," Longwall-Shortwall Mining, State Of The Art by R.V. Ramani, published by New York: Society of Mining Engineers of the American Institute of Mining, Metallurgical, and Petroleum Engineers, 1981, 7 pages.
Pramod C. Thakur, Stephen D. Lauer, and Joseph Cervik, "*Methane Drainge With Cross-measure Boreholes on a Retreat Longwall Face*," Preprint No. 83-398, Society of Mining Engineers of AIME, for presentation at the SME-AIME Fall Meeting and Exhibit, Salt Lake City, Utah, Oct. 19-21, 1983, 14 pages.
Warren F. Dobson and Daniel R. Seelye, "*Mining Technology Assists Oil Recovery from Wyoming Field*," SPE 9418, Society of Petroleum Engineers of AIME, Copyright 1980, 7 pages.
T.L. Logan, J.J. Schwoebel and D.M. Horner, "*Application of Horizontal Drainhole Drilling Technology for Coalbed Methane Recovery*,"SPE/DOE 16409, Society of Petroleum Engineers/U.S. Department of Energy, Copyright 1997, 12 pages.
Samuel O. Osisanya and Robert F. Schaffitzel, "*A Review of Horizontal Drilling and Completion Techniques for Recovery of Coalbed Methane*,"SPE 37131, Society of Petroleum Engineers, Copyright 1996, 13 pages.
S.D. Joshi, "*A Review of Horizontal Well and Drainhole Technology*," SPE 16868, Society of Petroleum Engineers, Copyright 1987, 17 pages.
R. Bitto, A.B. henderson and L. Broussard, "*Recent Case Histories of New Well Applications for Horizontal Drilling*," SPE 21262, Society of Petroleum Engineers, Copyright 1990, 12 pages.
M.R. Konopczynski, John Hughes and J.E. Best, "*A Novel Approach to Initiating Multi-Lateral Horizontal Wells*," SPE/IADC 29385, Society of Petroleum Engineers, Copyright 1996, 11 pages.
Kelly Falk and Craig McDonald, "*An Overview of underbalanced Drilling Applications in Canada*," SPE 30129, Society of Petroleum Engineers, Copyright 1995, 9 pages.
"*Evolution Toward Simpler, Less Risky Multilateral Wells*," World Oil, prepared from paper SPE/IADC 67825 by Adam Pasicznyk, Jun. 2001, 8 pages.
"*How Multilateral Boreholes Impact Ultimate Recovery Strategies*," OFFSHORE, Jul. 1997, 6 pages.
"*Trilateral Horizontal Wells Add 10 Million bbl for Unocal*," OFFSHORE, Dec. 1993, 2 pages.
Nicholas p. Chironis, "*New Borehole Techniques Offer Hope for Gassy Mines*," Coal Age, Jan. 1973, 4 pages.
A. Retnanto, T.P. Frick, C.W. Brand, and M.J. Economides, "*Optimal Configurations of Multiple-Lateral Horizontal Wells*," SPE 35712, Society of Petroleum Engineers, Copyright 1996, 8 pages.
T.L. Logan, "*Horizontal Drainhole Drilling Techniques Used for Coal Seam Resource Exploitation*," SPE 18254, Society of Petroleum Engineers, Copyright 1988, 13 pages.
David Hill, Eric Neme, Christine Enlig-Economides and Miguel Mollinedo, "*Reentry Drilling Gives New Life to Aging Fields*," Oilfield Review, Autumn 1996, 14 pages.
R.L. Thoms and R.M. Gehle, "*Feasibility of Controlled Solution Mining From Horizontal Wells*," Solution Mining Research Institute, Oct. 24-27, 1993, 8 pages.
"*World's First Trilateral Horizontal Wells on Stream*," Oil & Gas Journal, Nov. 29, 1993, 2 pages.
Margaret A. Adams, Jeanne l. Hewitt and Rodney D. Malone, "*Coalbed Methane Potential of the Appalachians*," SPE/DOE 10802, Society of Petroleum Engineers, Copyright 1982, 10 pages.
F.C. Schwerer and A.M. Pavone, " *Effect of Pressure-Dependent Permeability on Well-Test Analyses and Long-Term Production of Methane From Coal Seams*," SPE/DOE/GRI 12857, Society of Petroleum Engineers, Copyright 1984, 10 pages.
Stephen Krickovic and J.D. Kalasky, "*Methane Emission Rate Study in a Deep Pocahontas No. 3 Coalbed Mine in Conjunction With Drilling Degasification Holes in the Coalbed*," RI-7703, Bureau of Mines Report of Investigations/1972, United States Department of the Interior, 1972, 15 pages.
H.H. Fields, Joseph Cervik, and T.W. Goodman, "*Degasification and Production of Natural Gas From an Air Shaft in the Pittsburgh Coalbed*," RI-8173, Bureau of Mines Report of Investigations/1976, United States Department of the Interior, 1976, 28 pages.
Gerald L. Finfinger and Joseph Cervik, "*Drainage of Methane From the Overlying Pocahontas No. 4 Coalbed From Workings in the Pocahontas No. 3 Coalbed*," RI-8359, Bureau of Mines Report of Investigations/1979, United States Department of the Interior, 1979, 19 pages.
Gerald L. Finfinger and Joseph Cervik, "*Review of Horizontal Drilling Technology for Methane Drainage From U.S. Coalbeds*," IC-8829, Bureau of Mines Information Circular/1980, United States Department of the Interior, 1980, 24 pages.
Andre P. Jourdan and Guy A. Baron, "*Elf Drills 1,000+Ft Horizontally*," Petroleum Engineer International, Sep. 1981, 4 pages.
P.F. Conti, "*Controlled Horizontal Drilling*," SPE/IADC 18708, Society of Petroleum Engineers, Copyright 1989, 6 pages.
Armando R. Navarro, "*Innovative Techniques Cut Costs in Wetlands Drilling*," Oil & Gas Journal, Oct. 14, 1991, 4 pages.
Victor M. Luhowy and Peter D. Sametz, "*Horizontal Wells Prove Effective in Canadian Heavy-Oil Field*," Oil & Gas Journal, Jun. 28, 1993, 6 pages.
D. Lane Becker, "*Project Management Improved Multiwell Shallow Gas Development*," Oil & Gas Journal, Oct. 16, 1995, 5 pages.
Mike R. Chambers, "*Junction Design Based On Operational Requirements*," Oil & Gas Journal, Dec. 7, 1998, 7 pages.
A.J. Branch, et al., "*Remote Real-Time Monitoring Improves Orinoco Drilling Efficiency*," Oil & Gas Journal, May 28, 2001, 6 pages.
D. Keith Murray, "*Deep Coals Hold Big Part of Resource*," The American Oil & Gas Reporter, May 2002, 8 pages.
Nestor Rivera, et al., "*Multilateral, Intelligent Well Completion Benefits Explored*," Oil & Gas Journal, Apr. 14, 2003, 10 pages.

Handbood on Coal Bed methane Produced Water: Management And Beneficial Use Alternatives, prepared by ALL Consulting, Jul. 2003, 321 pages.
Nikola Maricic, "*Parametric and Predictive Analysis of Horizontal Well confiurations for Coalbed Methane Reservoirs in Appalachian Basin*," Thesis, West Virginia University, Department of Petroleum and Natural Gas Engineering, 2004, 162 pages.
Nikola Maricic, Shahab D. Mohaghegh, and Emre Artun, "*A Parametric Study on the Benefits of Drilling Horizontal and Multilateral Wells in Coalbed Methane Reservoirs*," SPE 96018, Society of Petroleum Engineers, Copyright 2005, 8 pages.
D.P. Schlick and J.W. Stevenson, "*Methane Degasification Experience at Jim Walter's*," Proceedings of the Twelfth Annual Institute on Coal Mining Health, Safety and Research, Aug. 25-27, 1981, 9 pages.
P.C. Thakur, "*Optimum Methane Drainage in Gassy Coal Mines*," 2003 SME Annual Meeting, copyright 2003 by SME, 4 pages.
Global Methane and the Coal Industry: A Two-Part Report on Methane Emissions from the Coal Industry and Coalbed Methane Recovery and Use, Coal Industry Advisory Board, International Energy Agency, copyright 1994, 72 pages.
Michael Schumacher, AKZO Salt Inc., "Solution Mining in the Nineties," believed to be in Dec. 2005, 8 pages.
Pratt et al., entitled "Cavity Well System," U.S. Appl. No. 11/141,335, May 31, 2005, 19 pages.
Michael Schumacher, Akzo Salt, Inc., et al., "Solution Mining in the Nineties," Presented at the Fall 1991 meeting of the Solution Mining Research Institute, Oct. 27-30, 1991, 11 pages.
Notification of Transmittal of the International Preliminary Report on Patentability (1 page), International Preliminary Report on Patentability (7 pages), and Amended Sheets (9 pages) for International Application No. PCT/US2004/012029 mailed Aug. 11, 2005.

* cited by examiner

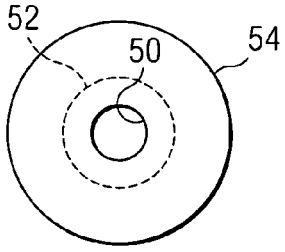
FIG. 3A
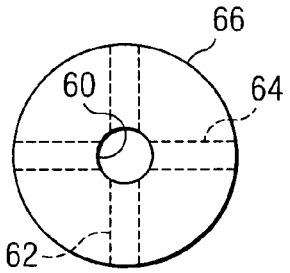
FIG. 3B
FIG. 6
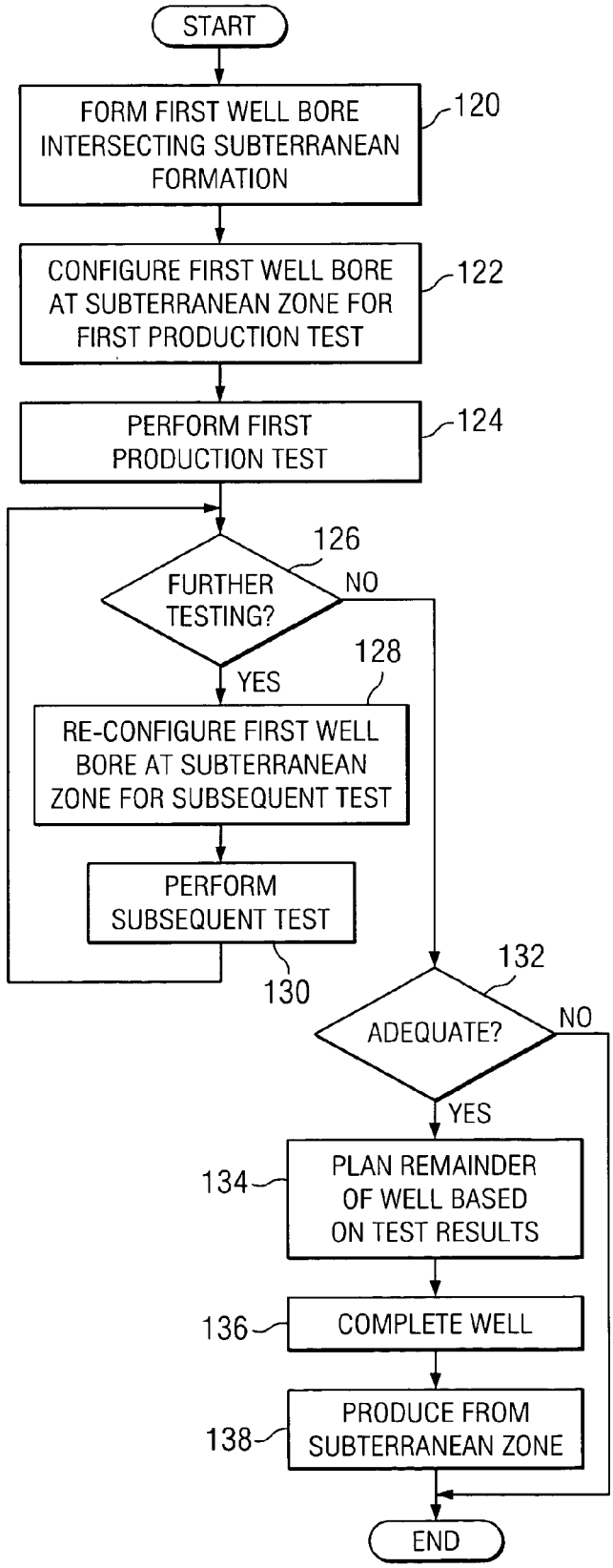

METHOD AND SYSTEM FOR TESTING A PARTIALLY FORMED HYDROCARBON WELL FOR EVALUATION AND WELL PLANNING REFINEMENT

TECHNICAL FIELD

The present invention relates generally to hydrocarbon recovery, and more particularly to a method and system for testing a partially formed hydrocarbon well for evaluation and well planning refinement.

BACKGROUND

Subterranean deposits of coal, shale and other formations often contain substantial quantities of methane gas. Vertical wells and vertical well patterns have been used to access coal and shale formations to produce the methane gas. More recently, horizontal patterns and interconnecting well bores have also been used to produce methane gas from coal and shale formations. For shale formations, production test from a vertical cavity well has been used to assess the desirability of drilling an intercepting well and pattern in the shale.

SUMMARY

A method and system for testing a partially formed gas well for evaluation and well planning refinement is provided. In a particular embodiment, various configurations of a partially formed well may be tested to evaluate the potential for the fully formed well and to refine planning for the remainder of the well.

In accordance with one embodiment, a system and method for testing a partially formed well includes forming a first well bore intersecting a subterranean formation. The first well bore includes a portion of a planned well having a first configuration. A production characteristic of the subterranean formation is tested through the first well bore in the first configuration. The first well bore is reconfigured to a second configuration different from the first configuration. The production characteristic of the subterranean formation is re-tested through the first well bore in the second configuration. Further formation of the planned well is planned based on testing of the subterranean formation through the first well bore in the first and second configurations.

Technical advantages of one or more embodiments of the method and system for testing a partially formed well include evaluating the potential for the fully formed well prior to completion of the well. As a result, non-profitable projects may be terminated prior to expenditure of the full drilling cost. Accordingly, costs for non-profitable projects are reduced or minimized and only projects with a high or known degree of profitability are completed.

Another technical advantage of one or more embodiments of the method and system for testing a partially formed well include improving well planning for a horizontal or other well pattern. In particular, lateral spacing, orientation, lateral angles and size of a horizontal well bore pattern may be planned and/or refined based on tests performed on the partially formed well before drilling of the well bore pattern. Accordingly, production or other characteristics of the well may be enhanced or maximized based on intermediate test data obtained during drilling operations.

The above and elsewhere described technical advantages of the present invention may be provided and/or evidenced by some, all or none of the various embodiments of the present invention. In addition, other technical advantages of the present invention may be readily apparent to one skilled in the art from the following figures, description, and claims.

BRIEF DESCRIPTION OF THE DRAWINGS

FIGS. 3A–B are top plan views illustrating various configurations of the first well bore of FIGS. 1 and 2 at the subterranean formation;

FIG. 6 is a flow diagram illustrating one embodiment of a method for testing a partially formed well to evaluate the well and refine well planning.

DETAILED DESCRIPTION OF THE INVENTION

Figure 1:
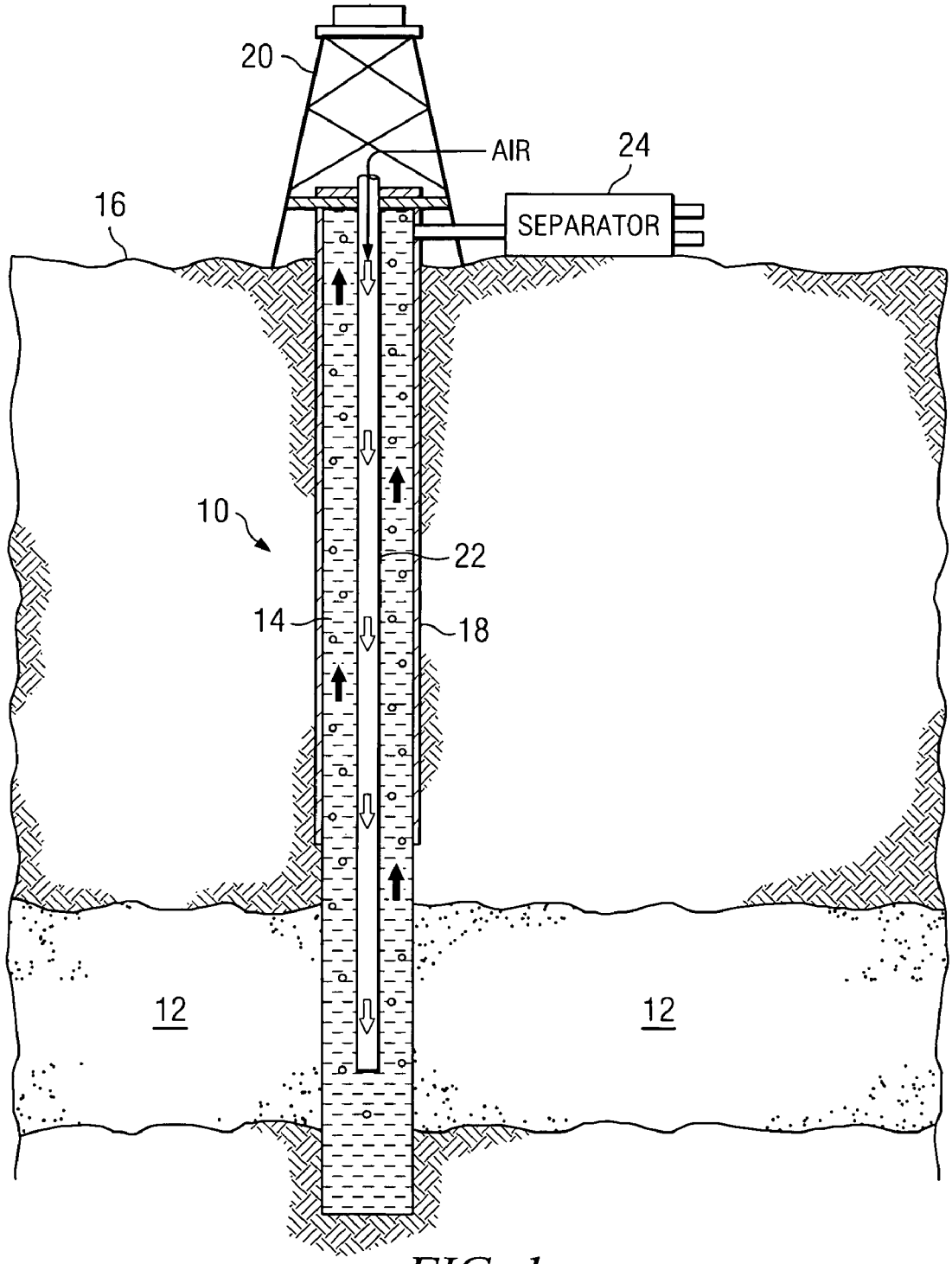
FIG. 1 illustrates one embodiment of testing of a subterranean formation through a first well bore of a partially formed well.

FIG. 1 illustrates one embodiment of a partially formed well 10. The planned, or completed well may comprise a further drilled or formed single well or a multi-well system with one or more additional bores for production of fluids from a subterranean, or subsurface, zone. The subterranean zone may be a coal seam 12, from which coal bed methane (CBM) gas, entrained water and other fluids are produced to the surface. In other embodiments, the subterranean formation may be a shale, carbonaceous or other suitable formation.

Referring to FIG. 1, the partially formed well 10 includes a first well bore 14 extending from the surface 16 to the coal seam 12. The first well bore 14 may intersect, penetrate and continue below the coal seam 12. The first well bore 14 may be lined with a suitable well casing 18 that terminates at or above the level of the coal seam 12. The first well bore 14 may in one embodiment be vertical, substantially vertical, straight, slanted and/or non-articulated in that it allows sucker rod, Moineau and other suitable rod, screw and/or other efficient bore hole pump or pumping systems, such as gas lift, to lift fluids up the first well bore 14 to the surface 16. Thus, the first well bore 14 may include suitable angles to accommodate surface 16 characteristics, geometric characteristics of the coal seam 12, characteristics of intermediate formations and/or may be slanted at a suitable angle or angles along its length or parts of its length. In particular embodiments, the well bore 14 may slant up to 35 degrees along its length or in sections but not itself be articulated to horizontal. In other embodiments, the first well bore 14 may be articulated and/or horizontal.

The first well bore 14 as well as the remaining portions of the planned well may be formed by a conventional or other drilling rig 20 or system. In one embodiment, the first well bore 14 has an initial, or first, configuration of the standard well bore at the coal seam 12. In this embodiment, the first well bore 14 has not been enlarged or otherwise altered at the coal seam 12 from the initial bore formed by drilling operations. In other embodiments, the first well bore 14 may be suitably altered to form a first configuration of the first well bore 14 for testing the coal seam 12.

After formation of the first well bore 14, initial testing of the coal seam 12 may be performed. Testing of the coal seam 12 or other subterranean formation may in one embodiment comprise a production flow test. In this embodiment, a tubing string 22 may be disposed in the first well bore 14 with an outlet proximate to the coal seam 12. Thus, the outlet may be disposed at the level of the coal seam 12 or a level above or below the coal seam 12. Compressed air or other gas, or fluid may be pumped down the tubing string and exit into the first well bore 14. The compressed air may be pumped by a compressor at the surface 16. The compressed air gas lifts water and other liquids and fluids produced by the coal seam 12 as well as remaining drilling fluids in the first well bore 14 to the surface 16.

After the first well bore 14 has been cleaned out, production flow or other production characteristic may be tested by collecting, monitoring and/or measuring water, gas, and other fluids produced from the coal seam 12 through the first configuration of the first well bore 14. Gas and water may be collected and separated at the surface 16 by a separator 24, with the amounts of water and/or gas monitored and measured. In one embodiment, production flow may be tested for a period of 24 hours. Production flow testing may occur for other suitable lengths of time. In addition, other production characteristics, including related well characteristics, may be tested. Production characteristics include, for example, bottom hole pressure, formation gas content, permeability or any other characteristic that is indicative of the rate or amount of production or a factor affecting production of one or more fluids from a subterranean zone. Thus, in one embodiment, rather than measuring a number of reservoir properties (pressure, content, permeability), a mini-production test is used to predict ultimate productivity of the future well.

Figure 2:
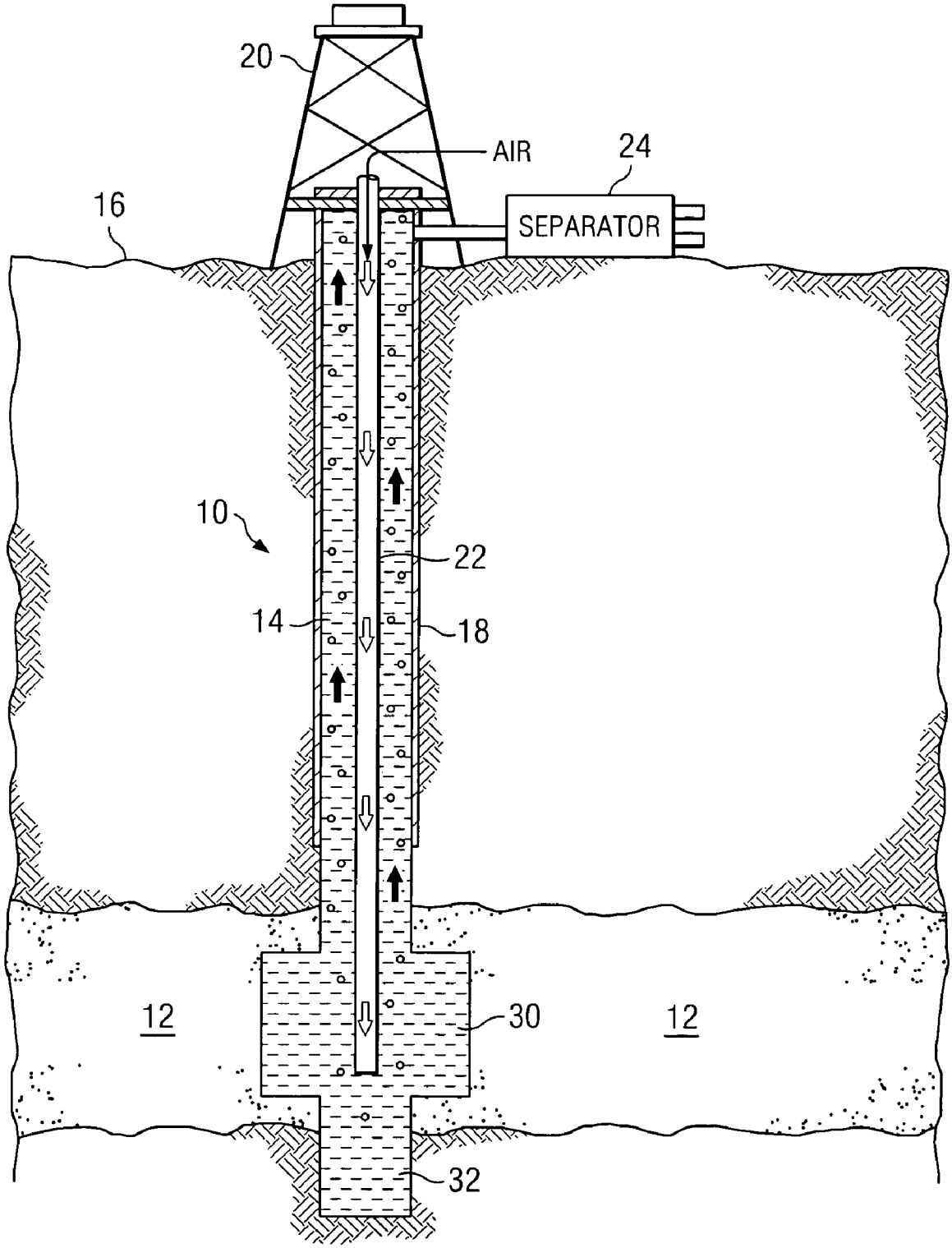
FIG. 2 illustrates one embodiment of testing a reconfigured first well bore of the partially formed well of FIG. 1 for evaluation of the subterranean formation and refinement of well planning.

FIG. 2 illustrates one embodiment of a second configuration of the first well bore 14 for further production testing of the coal seam 12. In this embodiment, the first well bore 14 is reconfigured to add a cavity 30 and production testing is again performed using gas lift. It will be understood that the first well bore 14 may be otherwise suitably reconfigured and that the type and/or manner of production testing may be different than for the initial configuration of the first well bore 14.

Referring to FIG. 2, a cavity 30 is formed in the first well bore 14 at the coal seam 12. The cavity 30 may be otherwise suitably positioned in the first well bore 14. The cavity 30 is an enlarged area of the first well bore 14 and may have any suitable configuration. As described in more detail below, the cavity 30 may be a generally cylindrical, or round cavity, a slot cavity or may have other suitable configurations. In a particular embodiment, the cavity 30 may have a diameter of two to three feet.

The cavity may have the height of the coal seam 12, a fraction thereof or a height greater than the coal seam 12. The cavity 30 may thus be wholly or partially within, above or below the coal seam 12 or otherwise in the vicinity of the coal seam 12. A portion of the first well bore 14 may continue below the enlarged cavity 30 to form a sump 32 for the cavity 30.

The cavity 30 may, in addition to testing, provide a point for intersection of the first well bore 14 by a second, articulated well bore used to form a horizontal, multi-branching or other suitable subterranean well bore pattern in the coal seam 12. The cavity 30 may also provide a collection point for fluids drained or otherwise collected from the coal seam 12 during production operations and may additionally function as a surge chamber, an expansion chamber and the like. In the slot cavity embodiment, the cavity 30 may have an enlarged substantially rectangular cross section perpendicular to a planned articulated well bore for intersection by the articulated well bore and a narrow depth through which the articulated well bore passes.

After the cavity 30 is formed, or the first well bore 14 is otherwise reconfigured, production testing of the coal seam 12 through the reconfigured first well bore 14 is conducted. In one embodiment, a production flow test is provided by again using the tubing string 22 in conjunction with a compressor to provide gas lift for fluids produced from the coal seam 12 to the surface 16. At the surface 16, gas and liquid may be separated by the separator 24 and the amounts of water and/or gas produced monitored and measured.

The first well bore 14 may be configured an additional one or more times by successively enlarging or otherwise modifying the cavity 30 or well bore to provide any suitable number of test results. The results at each stage or at the end of the process may be compared and one or more production characteristic of the coal seam 12 determined. For example, permeability, pressure, gas content, water content, flow characteristics, fracture incidents and/or fracture orientation may be determined based on the test results, including comparison between test results performed with different cavity configurations.

FIGS. 3A–B illustrate two embodiments of reconfigurations of the first well bore 14 in the coal seam 12. In particular, FIG. 3A illustrates reconfiguration the well bore 14 at the coal seam 12 with successively larger radial cavities during different stages of testing and well formation. FIG. 3B illustrates reconfiguration of first well bore 14 at the coal seam 12 to have a first slot cavity at a first orientation, a second slot cavity at a second orientation, and a full radial cavity during excessive stages of testing and well formation. A slot cavity is in one embodiment a cavity that extends substantially in two dimensions and has a limited depth in the third dimension. For example, a slot cavity may have a width and a height of a planned radial cavity but have a limited depth that is about one foot or less and/or that has a rectangular profile. The first well bore 14 may be otherwise reconfigured for testing of the coal seam 12 or other subterranean formation.

Referring to FIG. 3A, the first well bore 14 initially has a standard bore hole configuration 50 at the coal seam 12. After initial testing is completed, the first well bore 14 is enlarged at the coal seam 12 to form a first radial cavity configuration 52. After re-testing of the coal seam 12 through the first well bore 14 having the first radial cavity 52, the first well bore 14 is further enlarged at the coal seam 12 to form an enlarged or a full radial cavity configuration 54. The coal seam 12 may be re-tested through the first well bore 14 having the full radial cavity 54. Production flow test of the coal seam 12 through the first well bore 14 having the initial configuration 50, the intermediate cavity configuration 52 and the full cavity 54 configuration may allow the potential gas production from the coal seam 12 to be estimated or otherwise determined as well as characteristics of the coal seam 12 to be determined by testing production characteristics of the coal seam 12 with different sized cavities. Fracture spacing of the coal seam 12, for example, may be determined by an increase of production flow through the successively larger cavity configurations. Thus, it may be determined whether the planned well would be profitable, or the extent to which it would be profitable. As a result, the desirability of completing the well may be determined. In addition, planning of the remaining portion of the well may be refined. For example, the orientation of a well bore pattern in the coal seam 12, the type of pattern, the number and spacing of laterals of the pattern may be initially determined, or adjusted based on the permeability, fracture incidents, fracture orientation or other production characteristics of the coal seam 12.

Referring to FIG. 3B, the first well bore 14 initially has at the coal seam 12 a standard bore hole configuration 60. After testing of the coal seam 12 through the first well bore 14 having the initial configuration 60, the first well bore 14 at the coal seam 12 may be reconfigured to a first slot cavity configuration 62. The coal seam 12 may then be re-tested through the first well bore 14 having the first slot cavity configuration 62. Thereafter, the first well bore 14 may again be reconfigured to a second slot cavity configuration 64 in which a second slot cavity is formed that has an orientation different than the first slot cavity. In one embodiment, the second slot cavity may be oriented ninety (90) degrees from that of the first slot cavity. Production characteristics of the coal seam 12 may be again tested through the first well bore 14 having the second cavity configuration 64. Thereafter, a full radial cavity configuration 66 may be formed in the first well bore 14 at the coal seam and production characteristics of the coal seam again tested.

By testing production characteristics of the coal seam 12 with different orientations of the slot cavities, fracture orientation of the coal seam 12, for example, may be determined. For example, if the coal seam 12 has a fracture orientation parallel to the first slot cavity, none, one or only a small number of natural fractures formed by interconnected bedding planes, primary cleats and/or butt cleats of the coal seam 12 will intersect the cavity. The second slot cavity, however, would be perpendicular to the natural fractures and intercept a higher or substantial number of the fractures, thus increasing production flow during testing. Accordingly, based on production differences of the coal seam 12 through the first well bore 14 in the first cavity configuration 62 and the second cavity configuration 64 (which includes the first cavity), orientation of the natural fractures may be determined. As used herein, a characteristic or other information may be determined by calculating, estimating, inferring, or deriving the characteristic or information directly or otherwise from test results.

Figure 4:
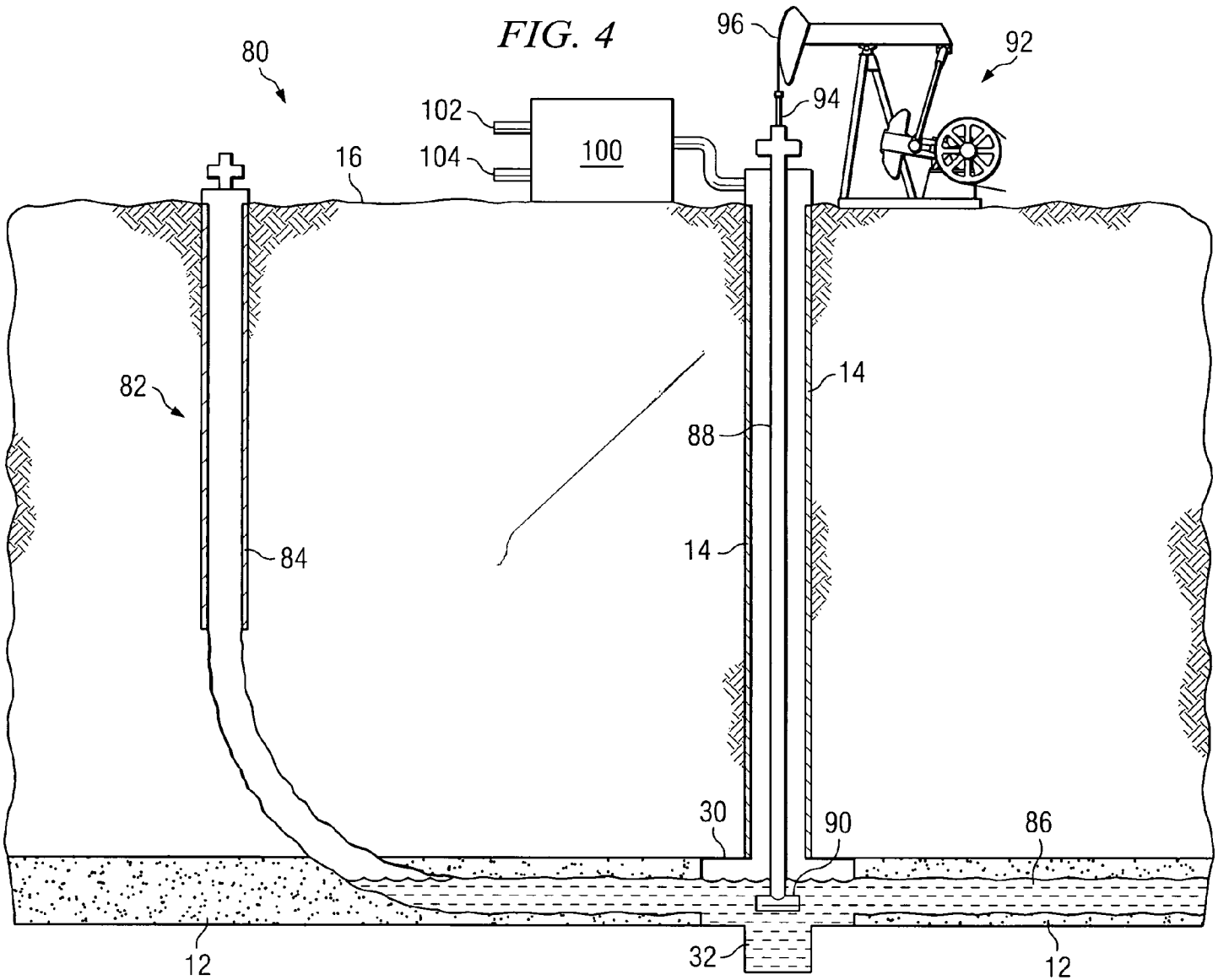
FIG. 4 illustrates one embodiment of production from the subterranean zone to the surface using a finished multi-well system.

FIG. 4 illustrates one embodiment of the completed well 80. In this embodiment, the well 80 is a multi-well system including the first well bore 14 and a second articulated well bore 82. As previously described, the articulated well bore 82 and/or connected drainage bore or pattern may be planned and configured based on production characteristics of the coal seam 12 determined during testing.

The second, articulated well bore 82 extends from the surface 16 to the cavity 30 of the first well bore 14. The articulated well bore 82 may include a substantially vertical portion, a substantially horizontal portion, and a curved or radiused interconnecting portion. The substantially vertical portion may be formed at any suitable angle relative to the surface 16 to accommodate geometric characteristics of the surface 16 or the coal seam 12. The substantially vertical portion may be lined with a suitable casing 84.

The substantially horizontal portion may lie substantially in the plane of the coal seam 12 and may be formed at any suitable angle relative to the surface 16 to accommodate the dip or other geometric characteristics of the coal seam 12. In one embodiment, the substantially horizontal portion intersects the cavity 30 of the first well bore 14. In this embodiment, the substantially horizontal portion may undulate, be formed partially or entirely outside the coal seam 12 and/or may be suitably angled. In another embodiment, the curved or radius portion of the articulated well bore 82 may directly intersect the cavity 30.

The articulated well bore 82 may be offset a sufficient distance from the first well bore 14 at the surface 16 to permit a large radius of curvature for portion of the articulated well and any desired length of portion to be drilled before intersecting the cavity 30. For a curve with a radius of 100-150 feet, the articulated well bore 82 may be offset a distance of about 300 feet at the surface from the first well bore 14. This spacing may allow the angle of the curved portion to be reduced or minimized to reduce friction in the articulated well bore 82 during drilling operations. As a result, reach of the drill string through the articulated well bore 82 is increased and/or maximized. The spacing greater than the radius may facilitate interception of the cavity 30. In another embodiment, the articulated well bore 82 may be located within close proximity of the first well bore 14 at the surface 16 to minimize the surface area for drilling and production operations. In this embodiment, the first well bore 14 may be suitably sloped or radiused to accommodate the radius of the articulated well bore 82.

A subterranean well bore, or well bore pattern 86 may extend from the cavity 30 into the coal seam 12 or may be otherwise coupled to a surface production bore 14 and/or 82. The well bore pattern 86 may be entirely or largely disposed in the coal seam 12. The well bore pattern 86 may be substantially horizontal corresponding to the geometric characteristics of the coal seam 12. Thus, the well bore pattern 86 may include sloped, undulating, or other inclinations of the coal seam 12.

In one embodiment, the well bore pattern 86 may be formed using the articulated well bore 82 and drilling through the cavity 30. In other embodiments, the first well bore 14 and/or cavity 30 may be otherwise positioned relative to the well bore pattern 86 and the articulated well bore 82. For example, in one embodiment, the first well bore 14 and cavity 30 may be positioned at an end of the well bore pattern 86 distant from the articulated well bore 82. In another embodiment, the first well bore 14 and cavity 30 may be positioned within the well bore pattern 86 at or between sets of laterals. In addition, the substantially horizontal portion of the articulated well bore 82 may have any suitable length and itself form the well bore pattern 86 or a portion of the well bore pattern 86. Also, as previously described, the completed well 80 may include only a single continuous well bore. In this embodiment, for example, the well bore pattern 86 may be formed through the first well bore 14.

Figure 5:
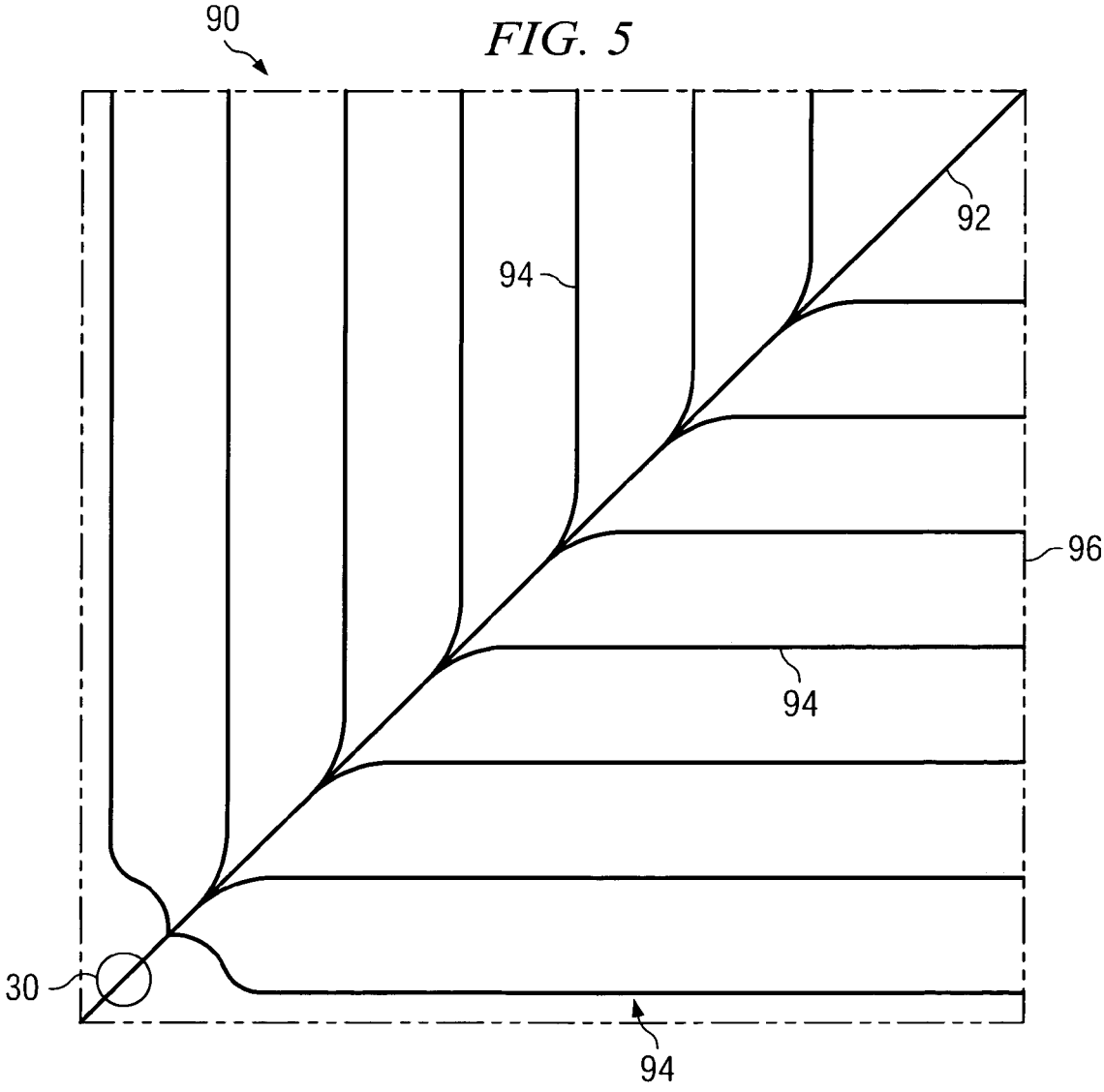
FIG. 5 is a top plan view illustrating one embodiment of a well bore pattern for the multi-well system of FIG. 4.

The well bore pattern 86 may be a well bore or an omni-directional pattern operable to intersect a substantial or other suitable number of fractures in the area of the coal seam 12 covered by the pattern 86. The omni-direction pattern may be a multi-lateral, multi-branching pattern, other pattern having a lateral or other network of bores or other pattern of one or more bores with a significant percentage of the total footage of the bores having disparate orientations. In these particular embodiments, the well bores of the pattern 86 may have three or more main orientations each including at least ten (10) percent of the total footage of the bores. The well bore pattern 86 may be as illustrated by FIG. 5, a pinnate pattern 90 having a main bore 92, a plurality of laterals 94 and a coverage area 96.

The second well bore 82 and other portions of the well 80 may be formed using conventional and other suitable drilling techniques. In one embodiment, the first well 14 is conventionally drilled and logged either during or after drilling in order to closely approximate and/or locate the vertical depth of the coal seam 12. The enlarged cavity 30 is formed in several steps using a suitable under-reaming technique and equipment such as a dual blade tool using centrifugal force, ratcheting or a piston for actuation, a pantograph and the like. Production characteristics of the coal seam 12 are tested using several cavity or other configurations of the first well bore 14. The articulated well bore 82 and well bore pattern 86 are drilled using a drill string including a suitable down-hole motor and bit. Gamma ray logging tools and conventional measurement while drilling (MWD) devices may be employed to control and direct the orientation of the bit and to retain the well bore pattern 86 within the confines of the coal seam 12 as well as to provide substantially uniform coverage of a desired area within the coal seam 12.

To prevent over-balanced conditions during drilling of the well bore pattern 86, air compressors may be provided to circulate compressed air down the first well bore 14 and back up through the articulated well bore 86. The circulated air will admix with the drilling fluids in the annulus around the drill string and create bubbles throughout the column of drilling fluid. This has the effect of lightening the hydrostatic pressure of the drilling fluid and reducing the down-hole pressure sufficiently such that drilling conditions do not become over-balanced. Foam, which may be compressed air mixed with water, may also be circulated down through the drill string along with the drilling fluid in order to aerate the drilling fluid in the annulus as the articulated well bore 82 is being drilled and, if desired, as the well bore pattern 86 is being drilled. Drilling of the well bore pattern 86 with the use of an air hammer bit or an air-powered down-hole motor will also supply compressed air or foam to the drilling fluid.

After the well bores 14 and 82, and the well bore pattern 86 have been drilled, the articulated well bore 82 may be capped. Production of water, gas and other fluids then occurs through, in one embodiment, the first well bore 14 using gas and/or mechanical lift. In this embodiment, a tubing string 88 is disposed into the first well bore 14 with a port 90 positioned in the cavity 30. The tubing string 88 may be a casing string for a rod pump to be installed after an initial period of gas lift and the port 90 may be the intake port for the rod pump. It will be understood that other suitable types of tubing operable to carry air or other gases or materials suitable for gas lift may be used.

For an initial gas lift phase of production (not shown), a compressor may be connected to the tubing string 88. Compressed gas, which may be, include or not include air or produced gas is pumped down the tubing string 88 and exits into the cavity 30 at the port 90. In the cavity 30, the compressed gas expands and suspends liquid droplets within its volume and lifts them to the surface. During gas lift, the rate and/or pressure of compressed gas provided to the cavity 30 may be adjusted to control the volume of water produced to the surface. In one embodiment, a sufficient rate and/or pressure of compressed gas may be provided to the cavity 30 to lift all or substantially all of the water collected by the cavity 30 from a coal seam 12. This may provide for a rapid pressure drop in the coverage area of the coal seam 12 and allow for kick-off of the well to self-sustaining flow within one, two or a few weeks. In other embodiments, the rate and/or pressure of gas provided may be controlled to limit water production below the attainable amount due to limitations in disposing of produced water and/or damage to the coal seam 12, well bore 14, cavity 30 and pattern 86 or equipment by high rates of production.

At the completion or in place of gas lift, a pumping unit 92 may be used to produce water and other fluids accumulated in the cavity 30 to the surface. The pumping unit 92 includes the inlet port 90 in the cavity 30 and may comprise the tubing string 88 with sucker rods 94 extending through the tubing string 88. The inlet 90 may be positioned at or just above a center height of the cavity 30 to avoid gas lock and to avoid debris that collects in the sump 32 of the cavity 30. The inlet 90 may be suitably angled with or within the cavity.

The sucker rods 94 are reciprocated by a suitable surface mounted apparatus, such as a powered walking beam 96 to operate the pumping unit 92. In another embodiment, the pumping unit 92 may comprise a Moineau or other suitable pump operable to lift fluids vertically or substantially vertically. The pumping unit 92 is used to remove water and entrained coal fines and particles from the coal seam 12 via the well bore pattern 86.

The pumping unit 92 may be operated continuously or as needed to remove water drained from the coal seam 12 into the enlarged cavity 30. In a particular embodiment, gas lift is continued until the well is kicked-off to a self-sustaining flow at which time the well is briefly shut-in to allow replacement of the gas lift equipment with the fluid pumping equipment. The well is then allowed to flow in self-sustaining flow subject to periodic periods of being shut-in for maintenance, lack of demand for gas and the like. After any shut-in, the well may need to be pumped for a few cycles, a few hours, days or weeks, to again initiate self-sustaining flow or other suitable production rate of gas.

Once the water is removed to the surface 16, it may be treated in gas/water separator 100 for separation of methane which may be dissolved in the water and for removal of entrained fines and particles. Produced gas may be outlet at gas port 102 for further treatment while remaining fluids are outlet at fluid port 104 for transport or other removal, reinjection or surface runoff. It will be understood that water may be otherwise suitably removed from the cavity 30 and/or well bore pattern 86 without production to the surface. For example, the water may be reinjected into an adjacent or other underground structure by pumping, directing or allowing the flow of water to the other structure.

After sufficient water has been removed from the coal seam 12, via gas lift, fluid pumping or other suitable manner, or pressure is otherwise lowered, coal seam gas may flow from the coal seam 12 to the surface 18 through the annulus of the well bore 14 around the tubing string 88 and be removed via piping attached to a wellhead apparatus. For some formations, little or no water may need to be removed before gas may flow in significant volumes.

The production stream of gas and other fluids and produced particles may be fed to the separator 100 through a particulate control system that monitors the production stream for an amount of particulate matter and regulate the rate of the production stream, or production rate, of the well 80, based on the amount of particulate matter. The particulate matter may be particles dislodged from the coal seam 12 at the periphery of and/or into the drainage well bores and/or cavity 30. In this embodiment, maintaining the production rate at a level that can be sustained by the well bore pattern 86 without damage or significant damage may prevent flow restrictions, clogging or other stoppages in the well bore pattern 86 and thereby reduce downtime and rework. Isolation of sections of the pattern 86 from production may also be eliminated or reduced.

FIG. 6 illustrates one embodiment of a method for testing a partially formed well. Referring to FIG. 6, the method begins at step 120 in which a first well bore 14 is formed. As previously described, the first well bore 14 intersects the subterranean formation to be produced. In one embodiment, the subterranean formation may be the coal seam 12. As previously described, the subterranean formation may be a shale or other suitable formation.

At step 122, the first well bore 14 is configured at the subterranean zone for a first production test. As previously described, the well bore 14 may have an initial configuration at the subterranean zone of the standard bore hole. Alternatively, the first well bore 14 may be enlarged or otherwise altered from the standard well bore for the first production test.

At step 124, the first test is performed and the results recorded. The first test may be a production flow or other suitable test operable to determine one or more production characteristics of the subterranean formation. As previously described, the production characteristic may be an indication of the rate or amount of production or a factor affecting production, such as permeability, pressure or other characteristic of the subterranean formation.

At decisional step 126, it is determined whether further testing is to be performed. In one embodiment, one production test of the subterranean formation may be performed. In other embodiments, two, three or more tests of the subterranean formation may be performed with the first well bore 14 reconfigured for one, more or all of the tests. If further testing is to be performed, the Yes branch of decisional step 126 leads to step 128. At step 128, the first well bore is reconfigured at the subterranean zone for subsequent testing and/or well formation. At step 130, subsequent testing is performed and the results recorded.

Upon the completion of testing, the No branch of decisional step 126 leads to decisional step 132. At decisional step 132, it is determined whether production from the subterranean formation is adequate to justify further drilling and completion of the well of which the first well bore 14 forms a part. If, based on production tests, the gas content, production rate or other factors indicate that completion of the well is not justified, the No branch of decisional step 132 leads to the end of the process and the well is not finished. In this event, production may continue out of the first well bore 14 or the first well bore 14 may be capped and abandoned.

If testing indicates the production potential for the subterranean formation is adequate or that the well should be completed, the Yes branch of decisional step 132 leads to step 134. At step 134, the remainder or other further formation of the well may be planned and/or planning refined, confirmed or altered significantly or otherwise based on the test results. Further formation of the well may be based on test results when determination of whether or not to finish the well is determined at least in part on the test results or where one or more characteristics of the remainder of the well and/or drilling of the remainder of the well are initially determined, modified or confirmed directly or indirectly using or otherwise considering the test results. In one embodiment, the type, orientation, size of the well bore pattern 86 may be determined based on the test results. In addition, the spacing and orientation of laterals in the well bore pattern 86 may also be determined based on the test results. At step 136, the well is completed. In one embodiment, the well may be completed by drilling an articulated well bore 82 intersecting the first well bore 14 and continuing through the first well bore 14 to form a horizontal well bore pattern 86. At step 138, production from the subterranean zone is commenced. Step 138 leads to the end of the process.

It is intended that the present invention encompass such changes and modifications as fall within the scope of the appended claims and their equivalence.

What is claimed is:

1. A method for testing a partially formed well, comprising:

forming a first well bore intersecting a subterranean formation, the first well bore comprising a portion of a well and having a first configuration;

testing a production characteristic of the subterranean formation through the first well bore in the first configuration;

reconfiguring the first well bore to a second configuration disparate from the first configuration by cutting the subterranean formation to enlarge a transverse dimension of the first well bore;

testing the production characteristic of the subterranean formation through the first well bore in the second configuration;

planning further formation of the well based on testing of the subterranean formation through the first well bore in the first and second configurations; and determining at least one characteristic of a substantially horizontal well bore pattern of the well based on testing of the first well bore in the first and second configurations.

2. The method of claim 1, wherein the first configuration comprises a substantially unaltered bore hole drilled to the subterranean formation.

3. The method of claim 1, wherein the second configuration comprises the first well bore with a substantially cylindrical cavity in the subterranean formation.

4. The method of claim 1, wherein the first configuration comprises the first well bore with a first enlarged area in the subterranean formation and the second configuration comprises the first well bore with a second further enlarged area in the subterranean formation.

5. The method of claim 1, wherein testing the production characteristic comprises performing a production flow test.

6. The method of claim 1, wherein the substantially horizontal well bore pattern characteristic comprises a lateral spacing.

7. A method for testing a partially formed well, comprising:

forming a first well bore intersecting a subterranean formation, the first well bore comprising a portion of a well and having a first configuration;

testing a production characteristic of the subterranean formation through the first well bore in the first configuration;

reconfiguring the first well bore to a second configuration disparate from the first configuration by cutting the subterranean formation to enlarge a transverse dimension of the first well bore;

testing the production characteristic of the subterranean formation through the first well bore in the second configuration;

planning further formation of the well based on testing of the subterranean formation through the first well bore in the first and second configurations; and wherein the second confuguration comprises the first well bore with a slot cavity in the subterranean formation.

8. A method for testing a partially formed well, comprising:

forming a first well bore intersecting a subterranean formation, the first well bore comprising a portion of a well and having a first configuration;

testing a production characteristic of the subterranean formation through the first well bore in the first configuration;

reconfiguring the first well bore to a second configuration disparate from the first configuration by cutting the subterranean formation to enlarge a transverse dimension of the first well bore;

testing the production characteristic of the subterranean formation through the first well bore in the second configuration;

planning further formation of the well based on testing of the subterranean formation through the first well bore in the first and second configurations; and wherein the first configuration comprises the first well bore with a slot cavity in the subterranean formation.

9. The method for testing a partially formed well, comprising:

forming a first well bore intersecting a subterranean formation, the first well bore comprising a portion of a well and having a first configuration;

testing a production characteristic of the subterranean formation through the first well bore in the first configuration;

reconfiguring the first well bore to a second configuration disparate from the first configuration by cutting the subterranean formation to enlarge a transverse dimension of the first well bore;

testing the production characteristic of the subterranean formation through the first well bore in the second configuration;

planning further formation of the well based on testing of the subterranean formation through the first well bore in the first and second configurations; and wherein the first cconfiguration comprises the first well bore with a first slot cavity in the subterranean formation and the second configuration comprises the first well bore with a first and second slot cavity in the subterranean formation.

10. A method for testing a partially formed well, comprising:

forming a first well bore intersecting a subterranean formation, the first well bore comprising a portion of a well and having a first configuration;

testing a production characteristic of the subterranean formation through the first well bore in the first configuration;

reconfiguring the first well bore to a second configuration disparate from the first configuration by cutting the subterranean formation to enlarge a transverse dimension of the first well bore;

testing the production characteristic of the subterranean formation through the first well bore in the second configuration;

planning further formation of the well based on testing of the subterranean formation through the first well bore in the first and second configurations;

wherein the first configuration comprises the first well bore with a first enlarged area in the subterranean formation and the second configuration comprises the first well bore with a second further enlarged area in the subterranean formation; and wherein the first enlarged area comprises a first cavity having a diameter between two and three feet and the second enlarged area comprises a cavity having a diameter ot greater than three feet.

11. A method for testing a partially formed well, comprising:

forming a first well bore intersecting a subterranean formation, the first well bore comprising a portion of a well and having a first configuration;

testing a production characteristic of the subterranean formation through the first well bore in the first configuration;

reconfiguring the first well bore to a second configuration disparate from the first configuration by cutting the subterranean formation to enlarge a transverse dimension of the first well bore;

testing the production characteristic of the subterranean formation through the first well bore in the second configuration;

planning further formation of the well based on testing of the subterranean formation through the first well bore in the first and second configurations; and further comprising determing whether to drill a second intersecting well bore of the planned well based on the testing of the first well bore in the first and second configurations.

12. A method for testing a partially formed well, comprising:

forming a first well bore intersecting a subterranean formation, the first well bore comprising a portion of a well and having a first configuration;

testing a production characteristic of the subterranean formation through the first well bore in the first configuration;

reconfiguring the first well bore to a second configuration disparate from the first configuration by cutting the subterranean formation to enlarge a transverse dimension of the first well bore;

testing the production characteristic of the subterranean formation through the first well bore in the second configuration;

planning further formation of the well based on testing of the subterranean formation through the first well bore in the first and second configurations; and further comprising determing an orientation and lateral spacing of a substantially horizontal well bore pattern of the well based on testing of the first well bore in the first and second configuration.

13. A method for forming a well, comprising drilling a first well bore intersecting a subterranean formation;

forming an enlarged cavity in the first well bore at the subterranean formation;

testing a characteristic of the subterranean formation through the well bore;

enlarging the cavity in the subterranean formation;

re-testing the characteristic of the subterranean information through the well bore having the enlarged cavity; and further drilling a bore hole associated wih the well bore based on testing and re-testing results.

14. The method of claim 13 wherein testing the charactertistic comprises performing a production flow test.

15. The method of claim 13 wherein enlarging the cavity in the subterranean formation comprises enlarging the cross-sectional area of the cavity.

16. The method of claim 15 wherein enlarging the cavity comprises forming a slot cavity in the subterranean formation.

17. The method of claim 15 further comprising determining whether to drill a second intersecting well bore based on the testing and re-testing results.

18. The method of claim 15 wherein the cavity and the enlarged cavity comprise cylindrical cavities having different diameters.

* * * * *